US006866100B2

(12) United States Patent
Gudmestad et al.

(10) Patent No.: US 6,866,100 B2
(45) Date of Patent: Mar. 15, 2005

(54) MECHANICALLY OPENED BALL SEAT AND EXPANDABLE BALL SEAT

(75) Inventors: Tarald Gudmestad, Houston, TX (US); David E. Hirth, Pasadena, TX (US); Gerald D. Pedersen, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 32 days.

(21) Appl. No.: 10/227,148

(22) Filed: Aug. 23, 2002

(65) Prior Publication Data

US 2004/0035586 A1 Feb. 26, 2004

(51) Int. Cl.[7] ..... E21B 34/00

(52) U.S. Cl. ..... 166/316; 166/373; 166/166; 166/319

(58) Field of Search ..... 166/120, 125, 166/134, 373, 382, 381, 316, 319; 175/321

(56) References Cited

U.S. PATENT DOCUMENTS

| | | | | |
|---|---|---|---|---|
| 4,062,406 A | | 12/1977 | Akkerman et al. | |
| 4,154,303 A | * | 5/1979 | Fournier | 166/317 |
| 4,230,185 A | | 10/1980 | Fredd | |
| 4,252,196 A | * | 2/1981 | Silberman et al. | 166/318 |
| 4,828,037 A | * | 5/1989 | Lindsey et al. | 166/382 |
| 4,862,966 A | | 9/1989 | Lindsey et al. | 166/382 |
| 4,869,324 A | | 9/1989 | Holder | 166/387 |
| 5,146,992 A | | 9/1992 | Baugh | 166/383 |
| 5,375,662 A | * | 12/1994 | Echols et al. | 166/386 |
| 5,553,672 A | | 9/1996 | Smith, Jr. et al. | 166/382 |
| 5,823,265 A | * | 10/1998 | Crow et al. | 166/373 |
| 5,826,652 A | * | 10/1998 | Tapp | 166/120 |
| 5,884,702 A | | 3/1999 | Yokley et al. | 166/290 |
| 5,960,879 A | * | 10/1999 | Echols | 166/278 |
| 5,960,881 A | | 10/1999 | Allamon et al. | 166/291 |
| 6,003,607 A | * | 12/1999 | Hagen et al. | 166/381 |
| 6,006,828 A | | 12/1999 | Kluth et al. | 166/156 |
| 6,009,943 A | | 1/2000 | Yokley et al. | 166/125 |
| 6,032,734 A | * | 3/2000 | Telfer | 166/66.5 |

FOREIGN PATENT DOCUMENTS

| | | |
|---|---|---|
| GB | 2 375 122 | 9/2003 |
| WO | WO 97/48880 | 12/1997 |

OTHER PUBLICATIONS

U.K. Search Report, Application No. GB 0319806.6, dated Feb. 18, 2004.

* cited by examiner

*Primary Examiner*—Frank Tsay
(74) *Attorney, Agent, or Firm*—Moser, Patterson & Sheridan, L.L.P.

(57) ABSTRACT

A method and apparatus for obstructing the passage of fluid within a fluid flow conduit and subsequently reconfiguring the tool to allow substantially full-bore passage therethrough. Pressure developed upstream of the obstruction can be utilized to operate pressure actuated tools such as liner hangers. Equipment used in subsequent wellbore operations such as drill pipe darts can pass undamaged through the opened port. In an embodiment, the flow through a tubular is obstructed by placing a ball on an expandable ball seat, developing a pressure differential across the ball seat, equalizing the pressure after the hydraulically actuated tool completes its function, and mechanically manipulating the drill string to open the expandable ball seat and allow the ball to pass through.

26 Claims, 18 Drawing Sheets

MECHANICALLY OPENED BALL SEAT AND EXPANDABLE BALL SEAT

BACKGROUND OF THE INVENTION

1. Field of the Invention

Embodiments of the present invention generally relate to methods and apparatus to sealably close and open a tubular within an oil and gas wellbore. More particularly, embodiments of the present invention generally relate to methods and apparatus for creating a fluid seal used to produce a pressure differential that is utilized to actuate a hydraulic tool downhole.

2. Description of the Related Art

Hydrocarbon wells typically begin by drilling a borehole from the earth's surface to a selected depth in order to intersect a hydrocarbon-bearing formation. Steel casing lines the borehole formed in the earth during the drilling process. This creates an annular area between the casing and the borehole that is filled with cement to further support and form the wellbore. Thereafter, the borehole is drilled to a greater depth using a smaller diameter drill than the diameter of the surface casing. A liner may be suspended adjacent the lower end of the previously suspended and cemented casing. This liner overlaps the casing enough to provide gripping engagement between the casing and liner when hung or suspended and extends to the bottom of the borehole.

In the completion of oil and gas wells, downhole tools are mounted on the end of a drill support member, commonly known as a work string. The work string may be rotated or moved in an axial direction from a surface platform or rig. Illustrative work strings include drill strings, landing strings, completion strings and production strings. Wellbore tubular members such as casing, liner, tubing, and work string define the fluid flow path within the wellbore. Commonly, a need arises to temporarily obstruct one or more of these fluid flow paths within the wellbore. An obstruction that seals the fluid flow path allows the internal pressure within a section of the tubular conduit to be increased. Hydraulically driven tools operate from this increased internal pressure. For example, a hydraulically operated liner hanger can be utilized to hang the liner to the well casing. However, a subsequent step in the completion of the oil or gas well may require the obstructed fluid path to be reopened without requiring the removal of the tubing string from the well in order to clear the obstruction.

Sealably landing a ball on a ball seat provides a common means of temporarily blocking the flow through a tubular conduit in order to operate a hydraulic tool thereabove. Thereafter, increasing pressure above the ball seat causes a shearable member holding the ball seat to shear, releasing the ball seat to move down hole with the ball. However, this leaves the ball and ball seat in the well bore, potentially causing problems for subsequent operations.

Another method of reopening the tubular conduit occurs by increasing the pressure above the ball seat to a point where the pressure forces the ball to deformably open the seat and allow the ball to pass through. In theses designs, the outer diameter of the ball represents the maximum size of the opening that can be created through the ball seat. This potentially limits the size of subsequent equipment that can pass freely through the ball seat and further downhole without the risk of damage or obstruction.

Hydraulic tools located above a ball seat are set to operate at a pressure below the pressure that opens or releases the ball seat. Internal pressures can become quite high when breaking circulation or circulating a liner through a tight section. In order to avoid premature operation of the tool at these times, the pressure required to open or release a ball seat needs to be high enough to allow for a sufficiently high activation pressure for the tool.

For example, predetermined open or release pressures that are set when the ball seat is assembled can exceed 3000 psi. Stored energy above the ball seat results from the compressibility of the fluid and any entrained gases along with the energy stored from the ballooning in the tubular conduit. Therefore, releasing or opening a ball seat by increased pressure can cause the ball to pass through the drill pipe at a relatively high velocity and prematurely release ball seats or shift sleeves located downhole. The large surge pressure created by the ball seat's release can also undesirably damage formations or cause hydraulic tools below the ball seat to actuate prematurely.

Even with precision manufacturing and extensive quality control, occasional malfunctions occur in the activation mechanisms of the tool and the release or opening mechanisms of the ball seat due to these devices' dependency on hydraulic pressure. For example, when the ball seat opens or releases at a lower pressure than planned, the hydraulically operated tool may not have activated or completed its function. Similarly, if the hydraulically operated tool does not function at its desired pressure, the ball seat may reach its release or opening pressure before the tool is activated.

Since the ball seat is a restriction in the wellbore, it must be opened up, moved out of the way, or located low enough in the well to not interfere with subsequent operations. Commonly, the ball seat is moved out of the way by having it drop down hole. Unfortunately, this may require the removal of both the ball and ball seat at a later time. Ball seats made of soft metals such as aluminum provide easier drill out; however, they may not properly seat the ball due to erosion caused by high volumes of drilling mud being pumped through the reduced diameter of the ball seat. Interference from the first ball seat being released downhole may also prevent the ball from sealably landing on another ball seat below. Current collet style mechanisms open up in a radial direction when shifted past a larger diameter grove. However, these ball seats are more prone to leaking than the solid ball seats, and the open collet fingers exposed inside the tubular create the potential for damaging equipment used in subsequent wellbore operations.

Wiper plugs often possess ball catchers that capture the ball when it is released. Thus, they must withstand the shock force imparted when the ball is released and subsequently caught. If a ball seat is alternatively placed in or at the bottom of the wiper plugs, then they must withstand the added force of the pressure acting on the ball seat. However, wiper plugs are built from materials that can be easily drilled in order to minimize drill out times. This requires a balance of strength versus drillability. Placing the ball seat above the wiper plugs provides an acceptable solution only if the released ball and ball seat do not interfere or obstruct the tubular passage during subsequent wellbore operations.

Therefore, there exists a need for an improved apparatus and method for temporarily blocking a fluid path in a wellbore in order to operate a hydraulic tool. There is a further need for a ball seat that does not depend on hydraulic pressure for release, that releases without causing a surge in the tubular below, that can be placed above the wiper plugs, that withstands an impact of a ball released above, that withstands erosion, and that leaves a substantially unobstructed passage through the bore once opened.

SUMMARY OF THE INVENTION

The present invention generally relates to a method and apparatus for obstructing the passage of fluid within a fluid flow conduit and subsequently reconfiguring the tool to allow substantially full-bore passage therethrough. Pressure developed upstream of the obstruction can be utilized to operate pressure actuated tools such as liner hangers. Equipment used in subsequent wellbore operations such as drill pipe darts can pass undamaged through the opened port. In one embodiment of the invention, the flow through a tubular is obstructed by placing a ball on an expandable ball seat, developing a pressure differential across the ball seat, equalizing the pressure after the hydraulically actuated tool completes its function, and mechanically manipulating the drill string to open the expandable ball seat and allow the ball to pass through.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
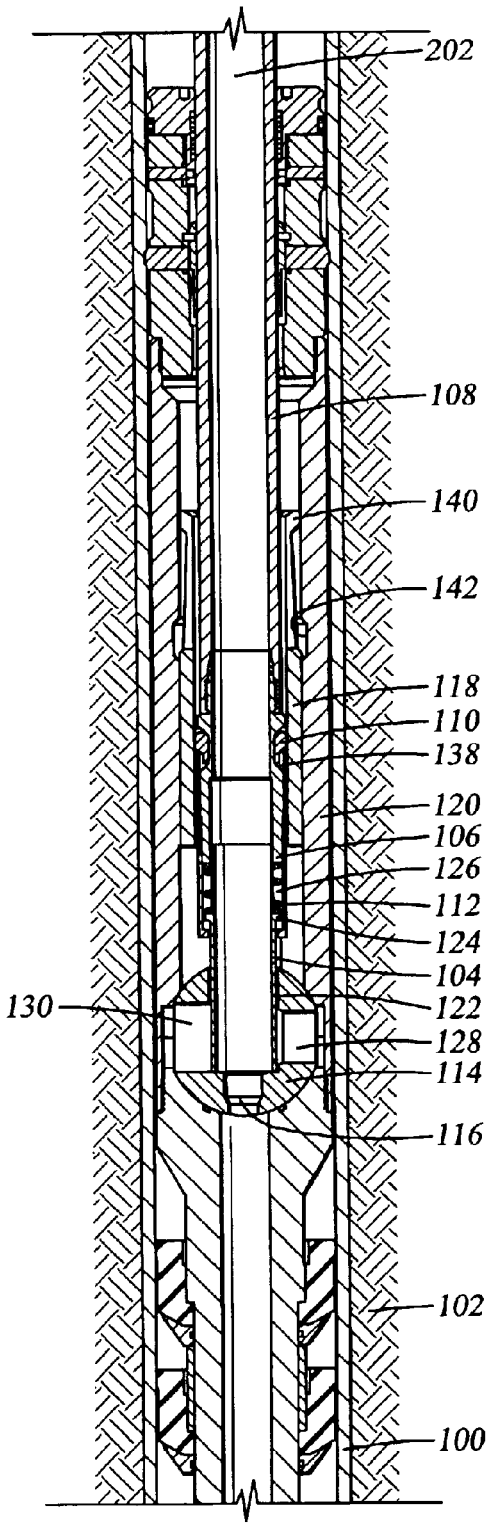
FIG. 1A is a longitudinal section view of an embodiment of the invention as it would appear when run in a well bore.
Figure 1C:
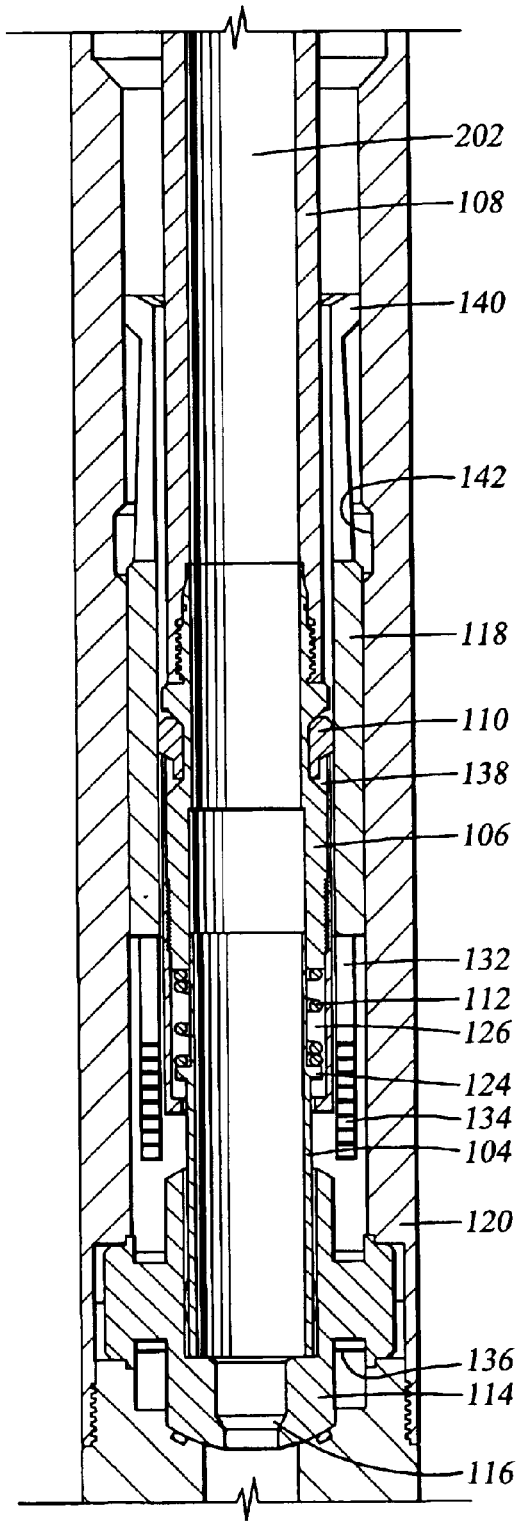
FIG. 1C is an enlarged view of FIG. 1A rotated 90° to better illustrate the rack and pinion assembly that rotates the multiposition valve.

The present invention generally relates to an apparatus and method for temporarily sealing a fluid flow conduit within a wellbore in order to operate hydraulic tools therein. FIG. 1A illustrates an embodiment of the present invention as it would appear positioned inside a liner 100 within a wellbore 102. Visible in FIG. 1A is a telescoping sleeve 104 held within a sub 106 that is connected to a work string 108, an expandable c-ring 110 that circumscribes the sub, a biasing member 112 that acts on the telescoping sleeve, a multiposition valve 114 with a ball seat 116, and a slideable inner sleeve 118 positioned inside an outer member 120. The axial position of the outer member is fixed relative to the liner 100. FIG. 1C provides a cross section view of the tool shown in FIG. 1A as it would appear rotated ninety degrees. An enlarged view of one embodiment of the multiposition valve as seen from the angle displayed in FIG. 1A is visible in FIG. 1B. Axial movement of the work string 108 can be performed from the surface of the well. In the run in position of FIG. 1, the rotation of the multiposition valve 114 is positioned so that the ball seat 116 within the multiposition valve is opposite an aperture in the multiposition valve that forms the first fluid flow pathway 122. Therefore, a channel is created through the multiposition valve that provides a substantially open bore and allows fluid to flow though the multiposition valve. When the tool is in the run in position, a telescoping sleeve 104 is located within the first fluid flow pathway 122 in the multiposition valve and rests on a portion of the multiposition valve adjacent to the ball seat. The telescoping sleeve 104 is held within the lower portion of the sub 106 by an outwardly biased shoulder 124 on the telescoping sleeve that travels within a cavity 126 created by an increased inner diameter of the sub. A biasing member 112 is located above the outwardly biased shoulder 124 on the telescoping sleeve 104 and within the cavity 126 formed by the telescoping sleeve 104 and the portion of the sub 106 with an increased inner diameter. Therefore, the biasing member 112 acts downward on the telescoping sleeve and allows for tolerance between the telescoping sleeve and the surfaces on the multiposition valve that it contacts. The inserted telescoping sleeve 104 within the multiposition valve 114 acts as a guide by preventing the ball 200 and fluid from entering other apertures 128 and 130 within the multiposition valve.

Figure 1B:
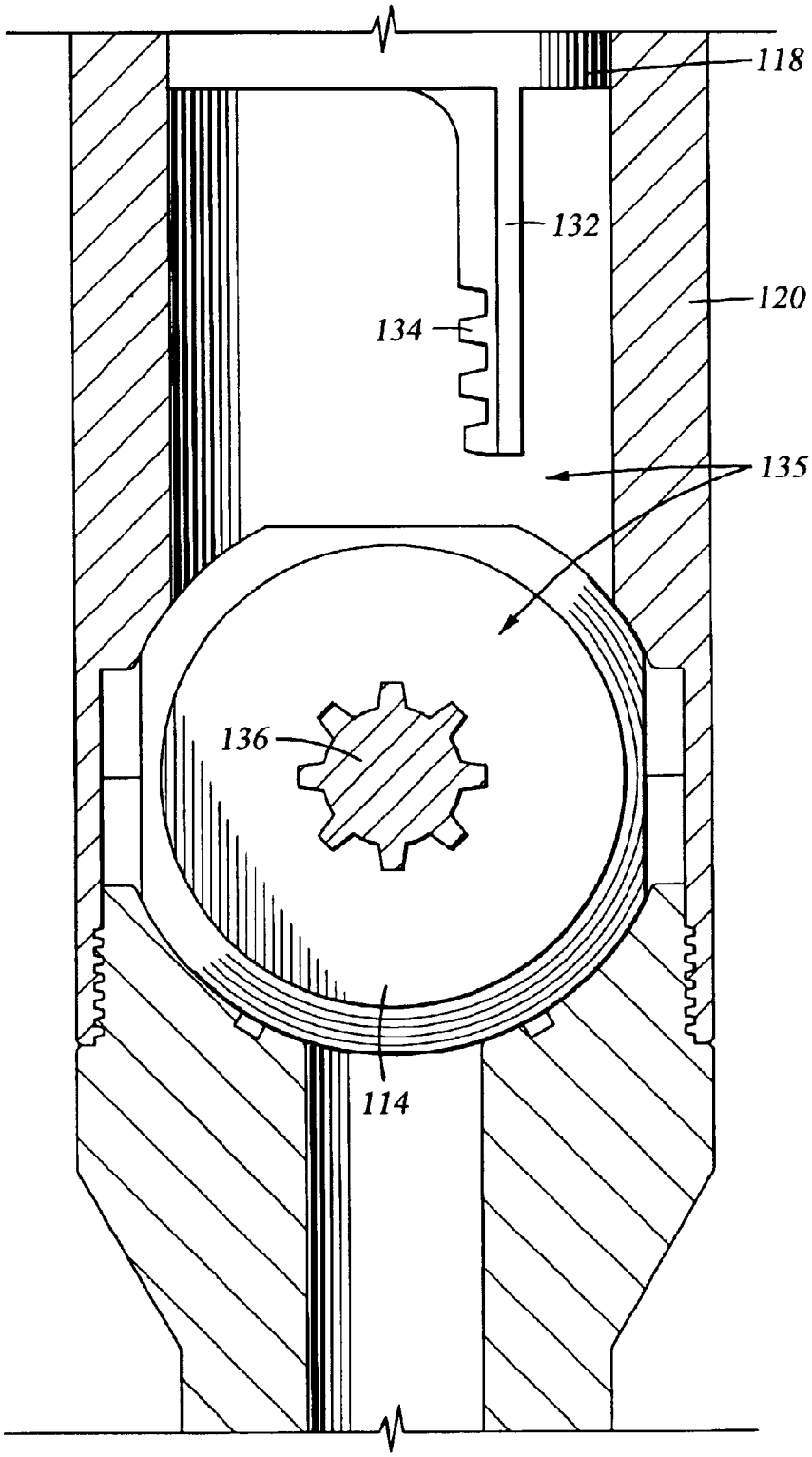
FIG. 1B is an enlarged partial view of a rack and pinion assembly that rotates a multiposition valve shown in the section view of FIG. 1A.

FIG. 1B illustrates an embodiment providing for the means of rotating the multiposition valve shown in FIG. 1A and FIG. 1C by a rack and pinion assembly 135. Two arms 132 extend from opposite sides of the inner sleeve's lower end. The ends of each arm possess teeth 134 that are aligned and positioned to engage gears 136 that are attached to the multiposition valve 114. Both the gears and the multiposition valve rotate in the same axis of rotation. FIG. 1B shows the position of the inner sleeve 118 as illustrated in FIG. 1A and FIG. 1C. Other known techniques known in the art may be utilized to provide the means of rotation for the multiposition valve 114. These techniques include but are not limited to linkage, levers, cams, torsion spring, and hydraulics.

Figure 2A:
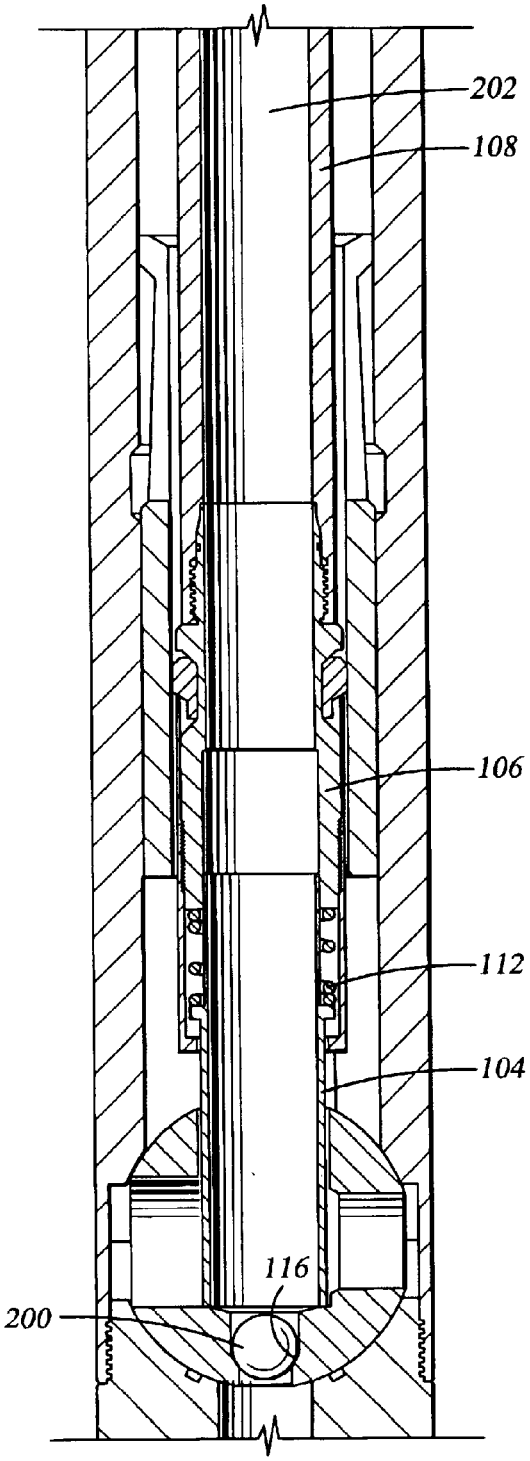
FIG. 2A is a view of the embodiment as shown in FIG. 1A with a ball positioned within the multiposition valve to close the axial fluid delivery bore.
Figure 2B:
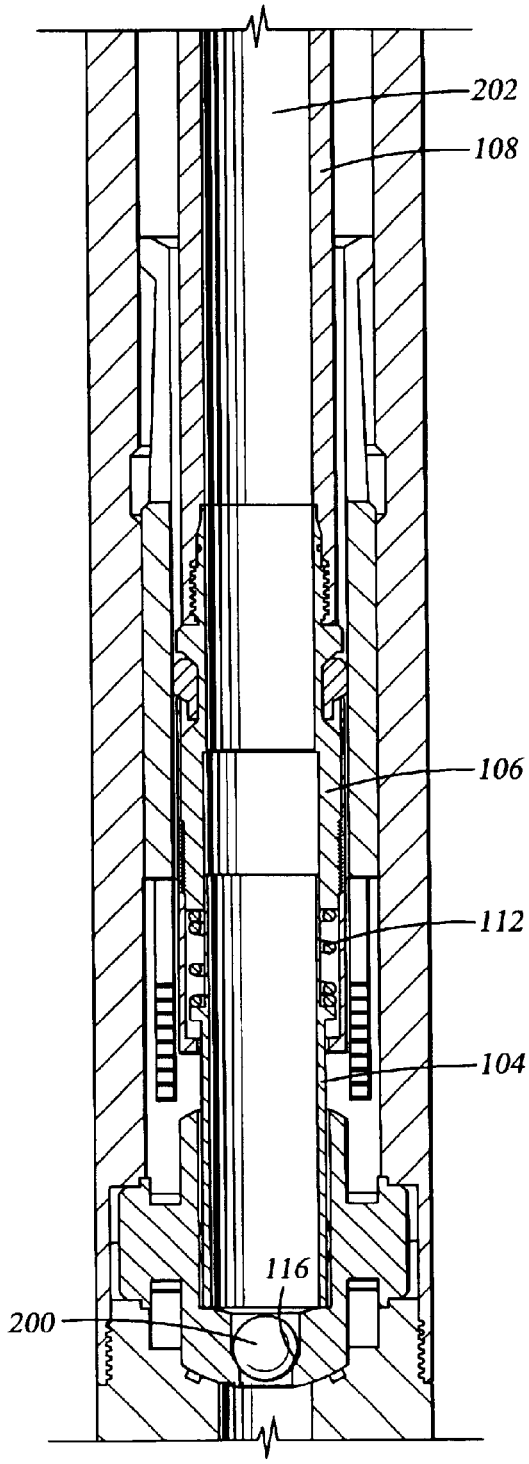
FIG. 2B is a view of FIG. 2A rotated 90° to better illustrate the rack and pinion assembly that rotates the multiposition valve.

An enlarged view of the tool shown in FIG. 1A is illustrated in FIG. 2A with a ball 200 seated on the ball seat 116. After the tool was in position and at a predetermined time, a ball 200 was dropped or pumped through the tubular from the surface. Since the inner diameter of the ball seat 116 is smaller than the outer diameter of the ball 200, the ball landed on the ball seat and obstructed the axial fluid flow path 202 to create a fluid seal above the ball and ball seat. Pressure above the ball seat can be increased to actuate a hydraulic tool such as a liner hanger (not shown). The pressure differential can be equalized once the hydraulic tool has been actuated. A small downward movement of the work string 108 is often utilized to disengage the setting tool upon completion of suspending the liner. This downward movement is transposed down through the work string 108, sub 106, and telescoping sleeve 104. Therefore, the biasing member 112 that keeps the telescoping sleeve in contact with the multiposition valve accommodates this movement. In the embodiment shown in FIG. 1A, the biasing member 112 is a spring.

Figure 3A:
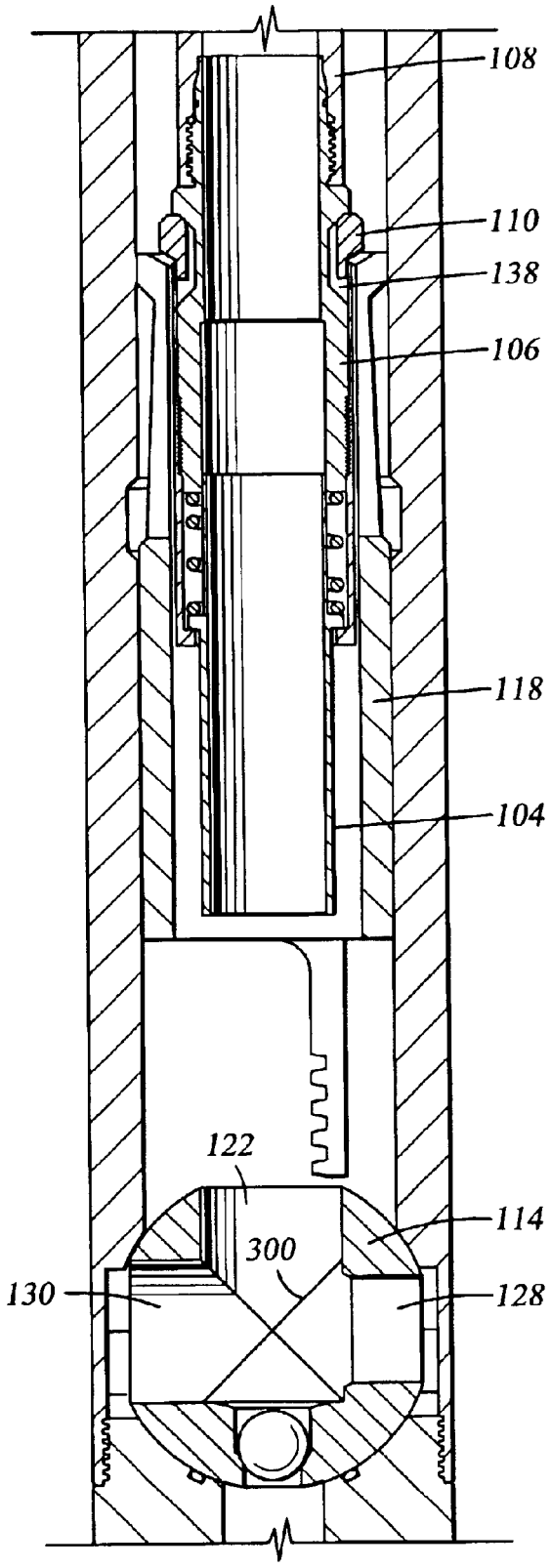
FIG. 3A is a view of the embodiment as shown in FIG. 1A during the first stage of the mechanical opening of the multiposition valve.
Figure 3B:
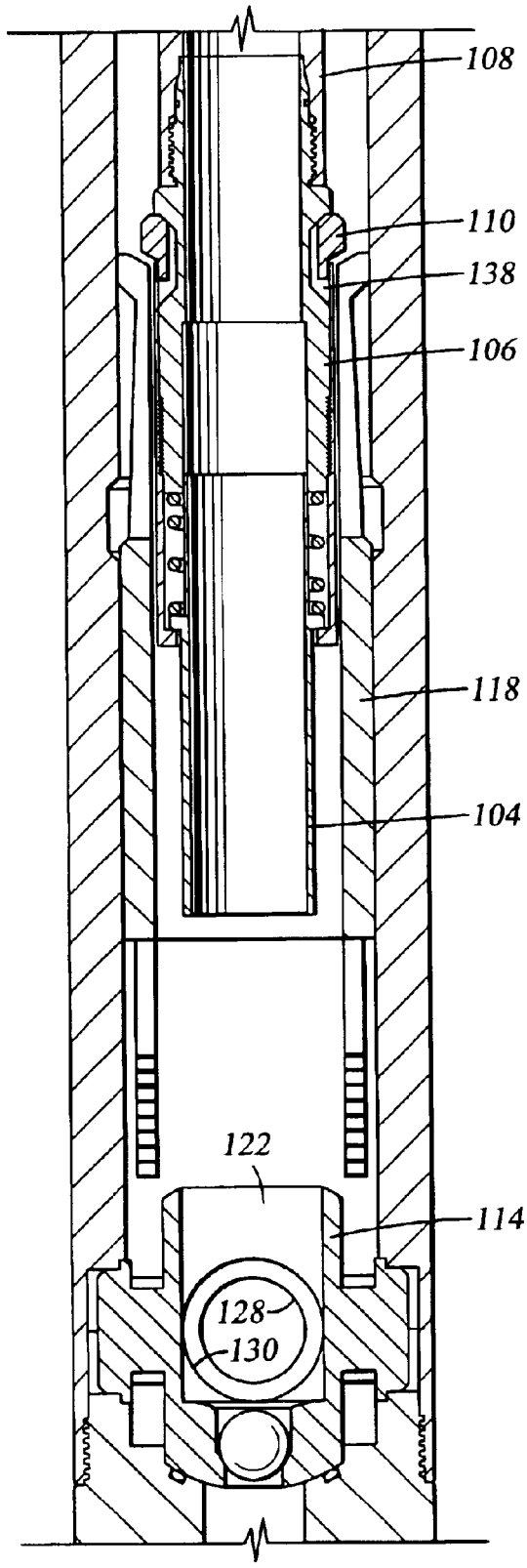
FIG. 3B is a view of FIG. 3A rotated 90° to better illustrate the rack and pinion assembly that rotates the multiposition valve.

FIG. 3A shows the device in FIG. 1A after the work string 108 has been moved up from the surface of the well. Support of the liner's weight is transferred to the casing (not shown) after the liner hanger (not shown) suspends the liner. Releasing the liner running tool from the liner 100 (shown in FIG. 1A) allowed relative motion between the work string 108 and the liner. Axial movement of the work string 108 moved the sub 106 and telescoping sleeve 104 within the tool. Therefore, FIG. 3 shows the tool after the work string 108 has been raised a distance greater than the measure between the c-ring 110 and the top of the inner sleeve 118 when in the run in position. At this point, checking the weight on the work string verifies that the liner is properly hung off since the work string should be free of the load created by the liner. The upward movement of the work string 108 raised the telescoping sleeve 104 to a position above the multiposition valve 114. In the run in position of the tool, the c-ring 110 is held in a compressed state within a preformed profile 138 on the sub 106 by the inner diameter of the inner sleeve 118 preventing its expansion. Therefore, the c-ring has expanded to its relaxed state since it is now positioned above the inner sleeve. However, the inner diameter of the c-ring 110 remains smaller than the outer diameter of the sub 106, and the outer diameter of the c-ring 110 is now larger than the inner diameter of the inner sleeve 118. Thus, a portion of the top of the preformed profile 138 within the sub 106 contacts a portion of the top of the c-ring 110 and a section of the bottom of the c-ring 110 contacts a section of the top of the inner sleeve 118. The "X" 300 visible in FIG. 3A represents the convergence of the first fluid flow pathway 122, the fluid flow pathway two 128, and the fluid flow pathway three 130.

Figure 4A:
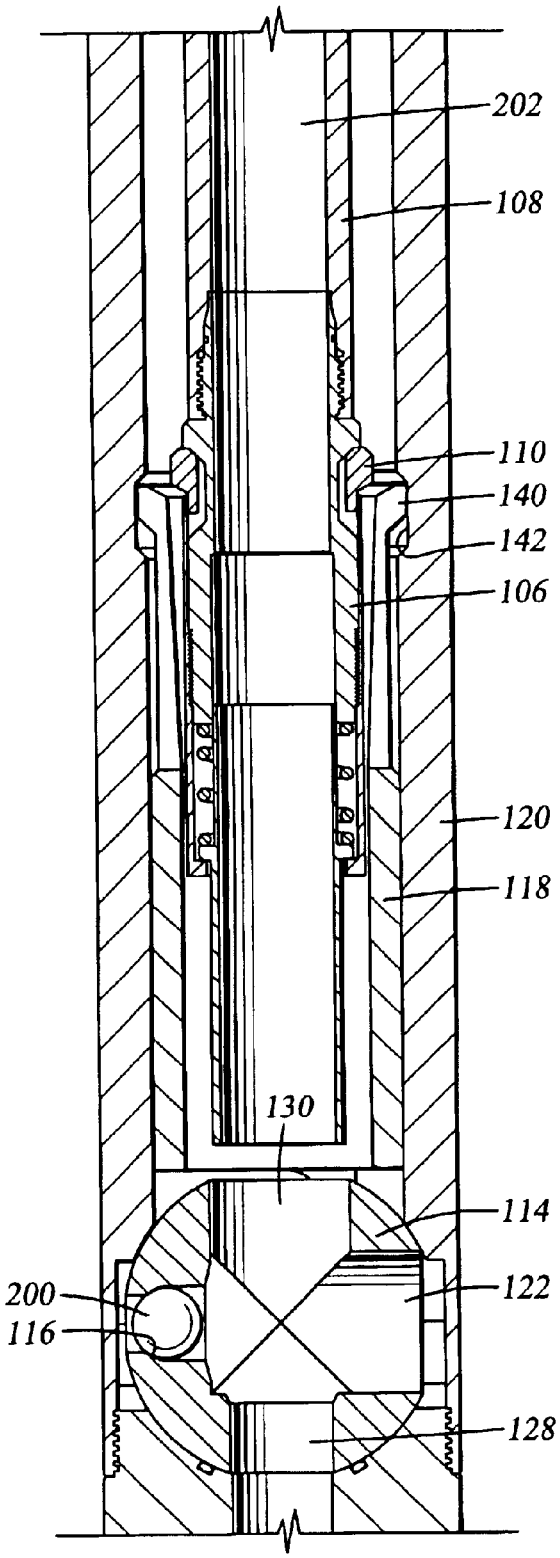
FIG. 4A is a view of the embodiment as shown in FIG. 1A immediately after rotation of the multiposition valve opens the axial fluid delivery bore.

In FIG. 4A, the inner sleeve 118 has been moved axially downwards in relation to the outer member 120 in order to place the tool in its open position. Movement of the inner sleeve in relation to the outer member occurred by mechanical axially downward movement of the work string 108 from the surface. Axial movement of the work string also moved the attached sub 106 axially. The uncompressed c-ring 110 contacted with the sub 106 and inner sleeve 118 to transfer the sub's axial movement to the inner sleeve 118. Therefore, the work string 108, sub 106, c-ring 110, and inner sleeve 118 moved axially in unison through the outer member 120.

Figure 4C:
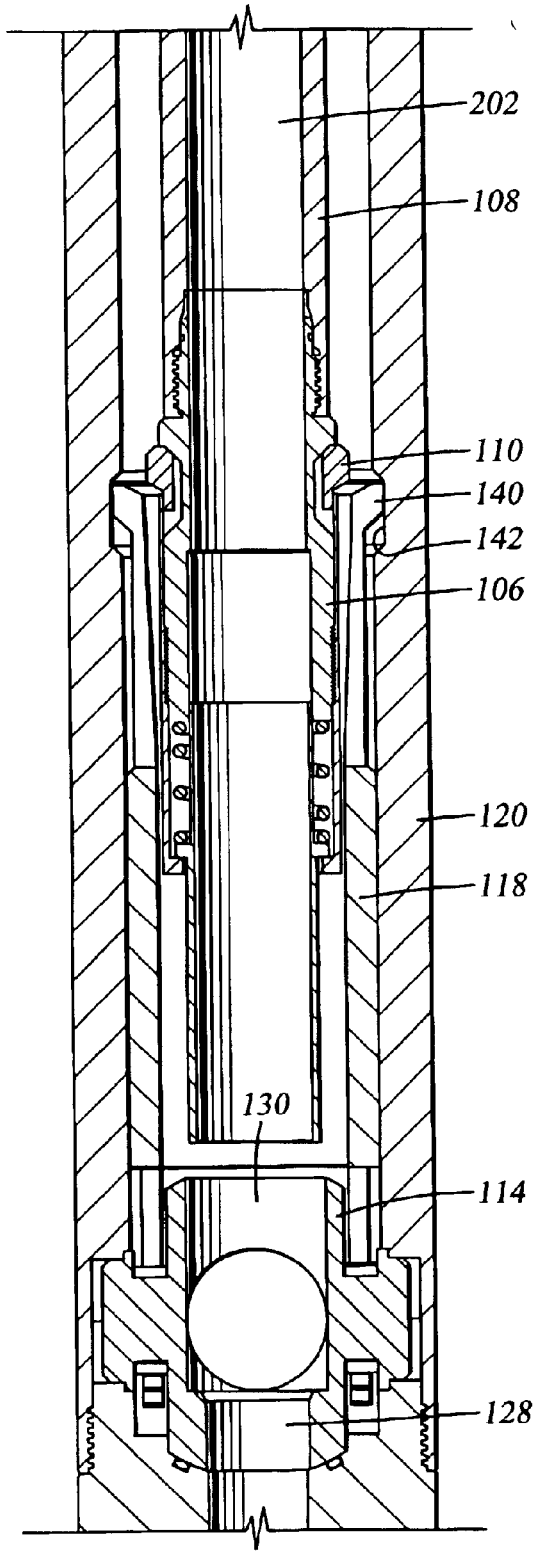
FIG. 4C is a view of FIG. 4A rotated 90° to better illustrate the rack and pinion assembly that rotates the multiposition valve.
Figure 4B:
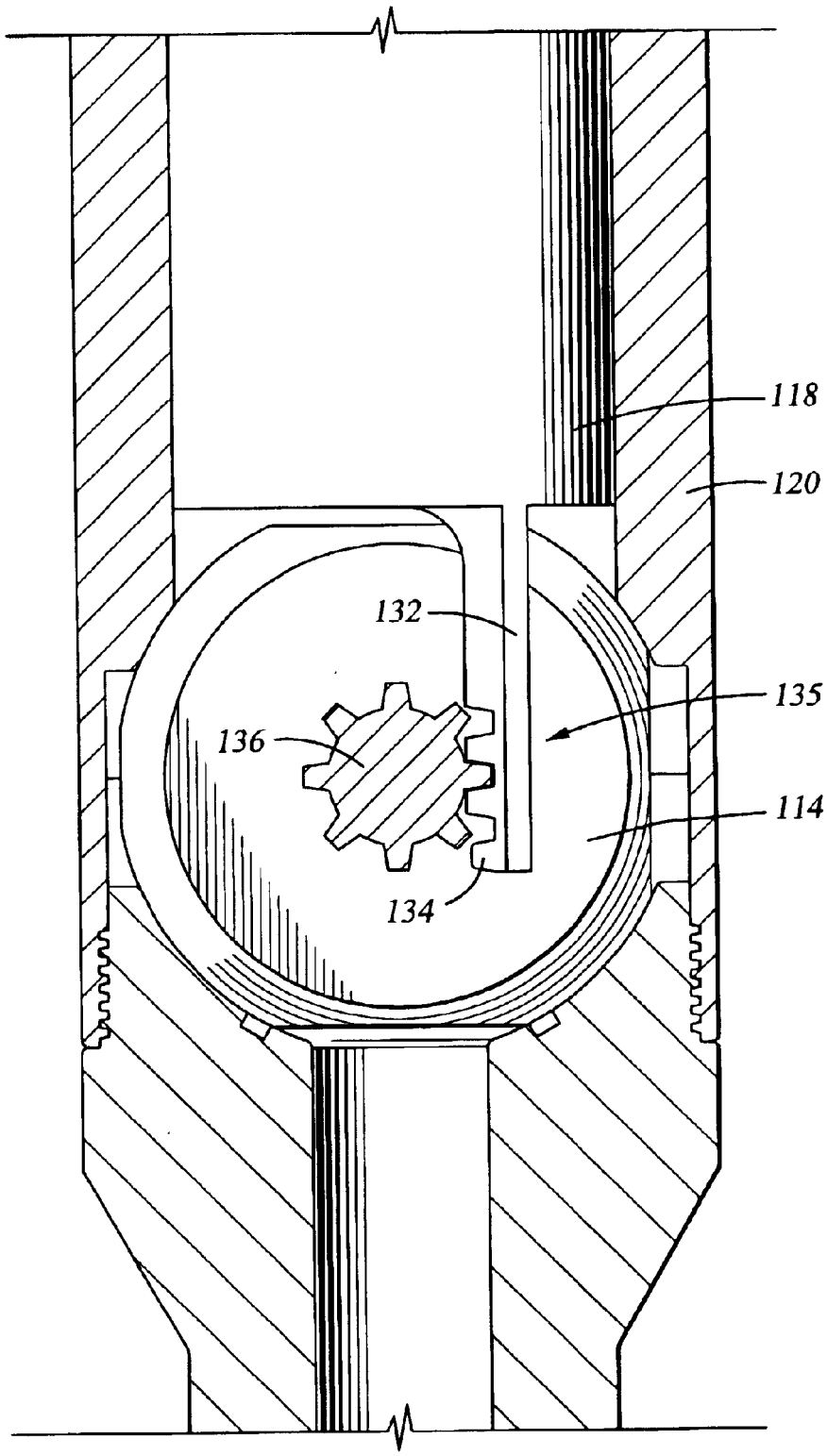
FIG. 4B is an enlarged partial view of the rack and pinion assembly that rotates the multiposition valve.

The inner sleeve continued sliding through the outer member until the plurality of outwardly biased collet fingers 140 located on the top of the inner sleeve expanded into a preformed profile 142 on the outer member. Outward expansion of the collet fingers increased the inner diameter of the top portion of the inner sleeve. Therefore, the enlarged inner diameter of the inner sleeve is larger than the outer diameter of the uncompressed c-ring 110. Sliding the inner sleeve 118 from its run in position to the open position in FIG. 4 rotated the multiposition valve 114 approximately ninety degrees. The rotation positioned the ball 200 and ball seat 116 from being aligned in the axial fluid delivery bore 202 to a position adjacent to the axial fluid delivery bore. In the open position, fluid flow pathway two 128 and fluid flow pathway three 130 are apertures in the multiposition valve 114 that are aligned with the axial fluid delivery bore 202 to provide a substantially open passage through the multiposition valve. Initially, the ball 200 stays seated on the ball seat 116 during the rotation of the multiposition valve due to frictional contact between the ball 200 and ball seat 116. FIG. 4B depicts a view of the gear 136 on the multiposition valve 114 after the inner sleeve 118 has been lowered and the multiposition valve 114 has been subsequently rotated as shown in FIG. 4A and FIG. 4C. While the foregoing describes sliding the inner sleeve 118 with axial movement of the workstring, known methods of utilizing rotational movement of the workstring may be used to accomplish the same axial movement of the inner sleeve.

Figure 5A:
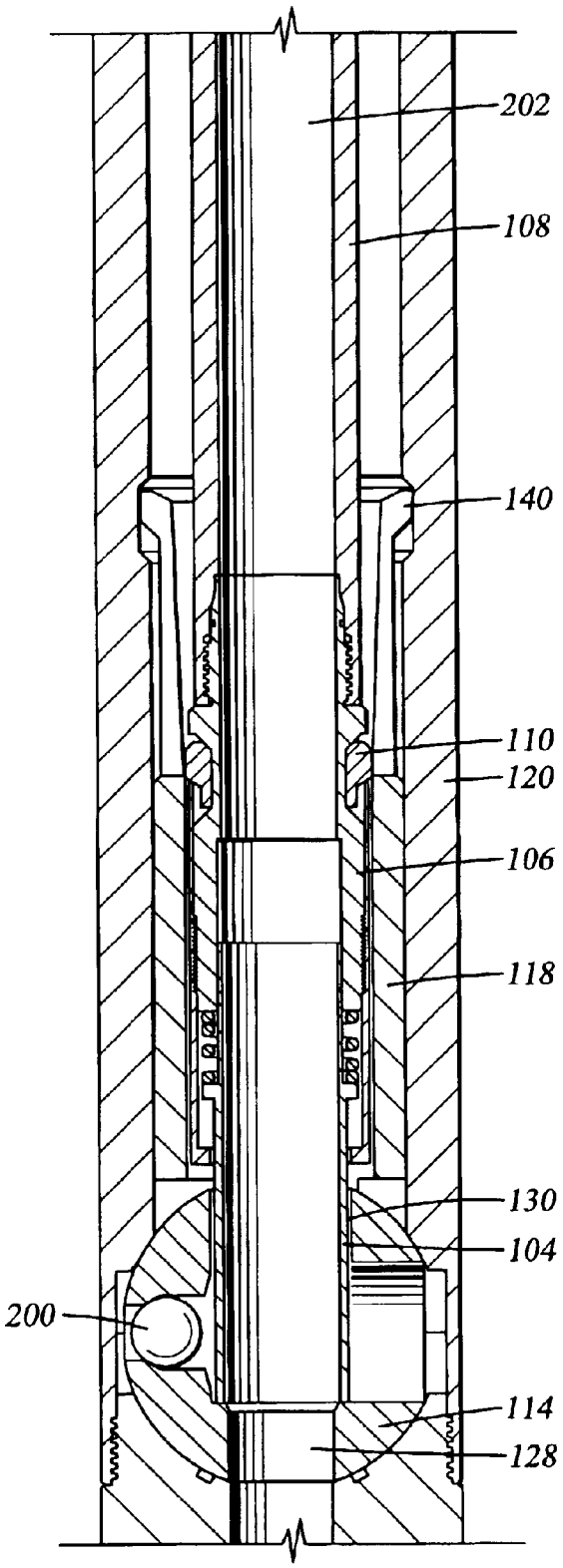
FIG. 5A is a view of the embodiment as shown in FIG. 1A during the stage following the rotation of the multiposition valve.
Figure 5B:
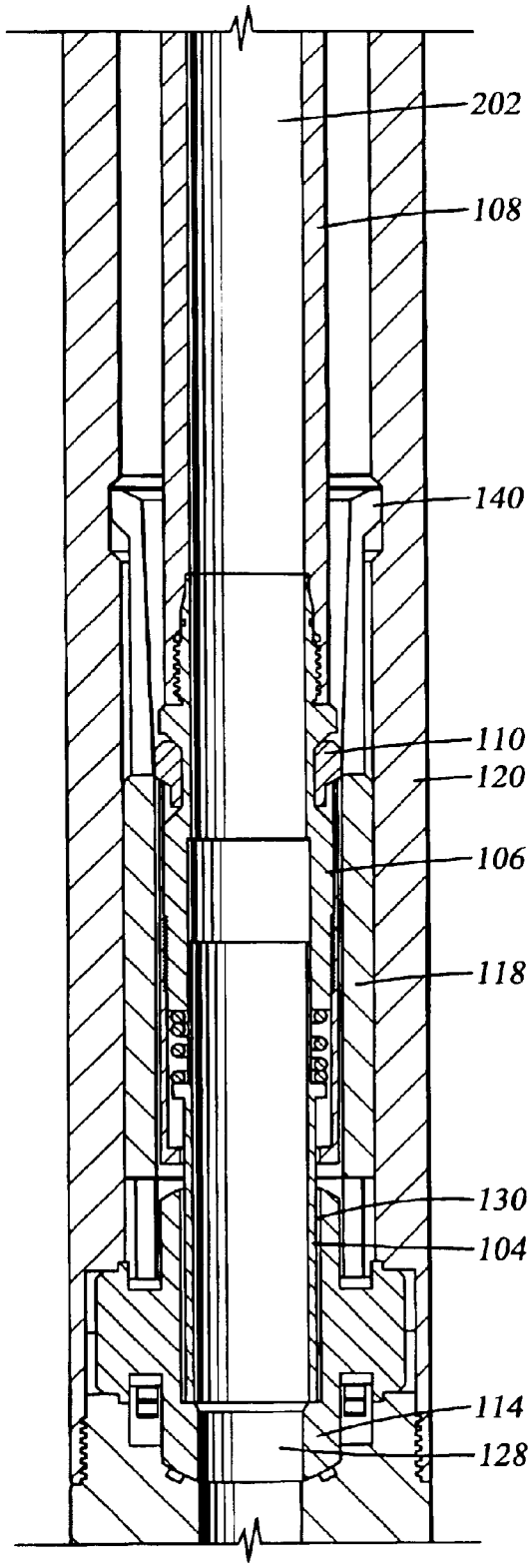
FIG. 5B is a view of FIG. 5A rotated 90° to better illustrate the rack and pinion assembly that rotates the multiposition valve.

FIG. 5A illustrates the final position of the embodiment shown in FIG. 1A with the telescoping sleeve 104 inserted into the multiposition valve 114. Movement of the telescoping sleeve 104 into fluid flow pathway three 130 on the multiposition valve occurred by continued mechanical axially downward movement of the work string 108 from the surface. Due to the lack of contact between the c-ring 110 and the top of the inner sleeve 118, the work string 108 and sub 106 passed inside the inner sleeve 118 that was held in position on the outer member 120 by collet fingers 140 engaging the outer member 120. A lower portion of the telescoping sleeve 104 contacts a surface adjacent the fluid flow pathway two 128 on the multiposition valve. Therefore, the telescoping sleeve 104 traps the ball 200 within the multiposition valve thereby blocking the ball 200 from entering the axial fluid delivery bore 202 and closes other apertures on the multiposition valve in order to guide subsequent equipment (not shown) through the multiposition valve.

Figure 6:
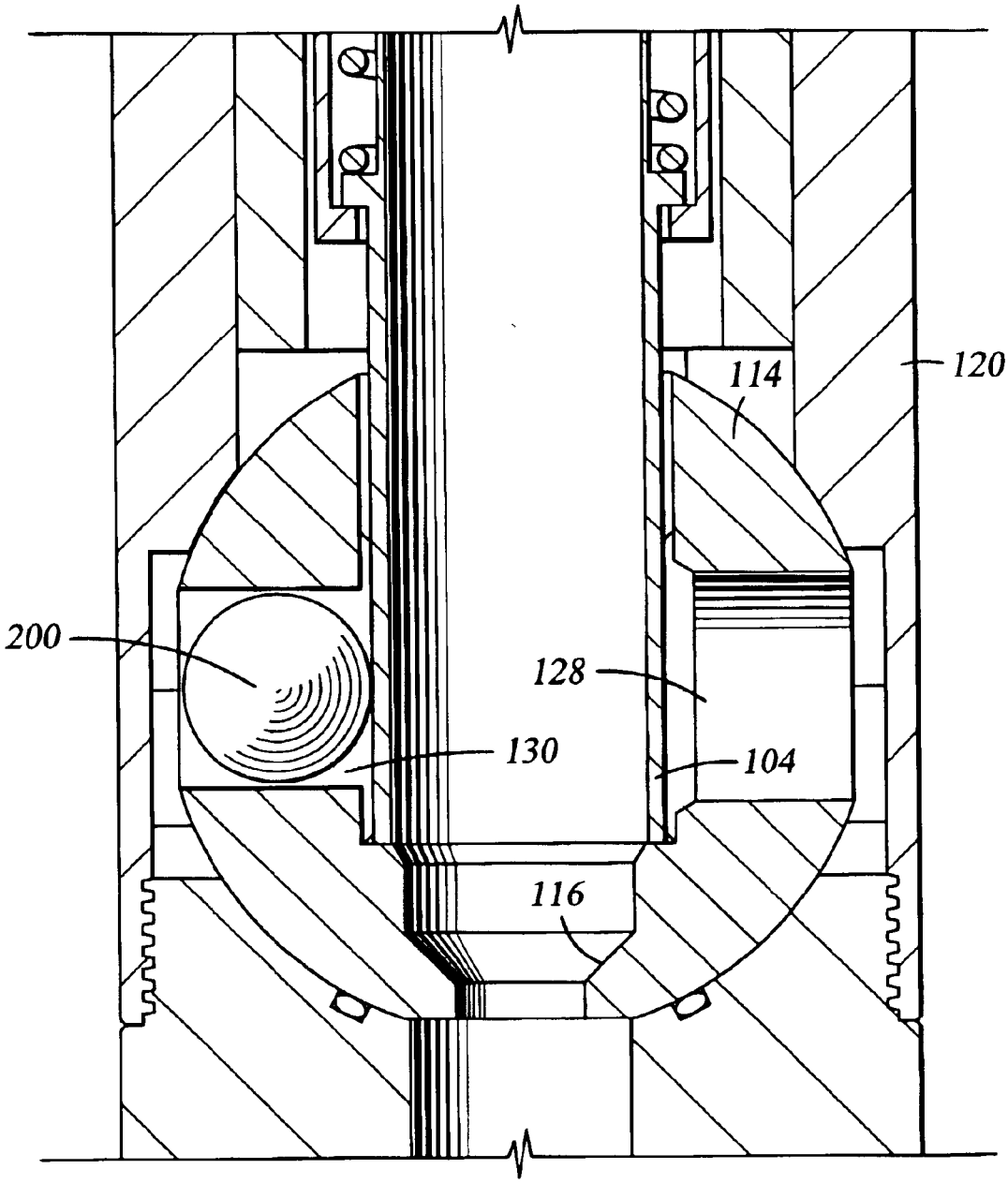
FIG. 6 is an enlarged longitudinal section view of an alternative embodiment of the multiposition valve as it would appear when run in the well bore.

FIG. 6 illustrates an embodiment of the invention shown in FIG. 1A wherein the ball 200 (which could be a different size than the ball supposed to land in ball seat 116) is carried within the multiposition valve 114 in flow pathway two 128 or three 130 in the run in position of the tool. Upon operation of the tool resulting in flow pathway two 128 and flow pathway three 130 to be aligned with the main bore of the tool, the ball will be released in order to sealably land on a ball seat further downhole. In addition, one skilled in the art may envision a rotatable valve similar to the one described herein that possesses a closed portion in the place of the ball seat. One skilled in the art could also foresee a multiposition valve like the one described in FIGS. 1–6 that rotates to more than two positions.

Additionally, rather than rotating a valve to an open position, a valve could be utilized having at least one additional flow pathway with an axis therethrough that is parallel to the axis of a flow pathway having a ball seat therein. By shifting the valve components laterally, a second, substantially unobstructed flow pathway could be provided through the valve.

Figure 7:
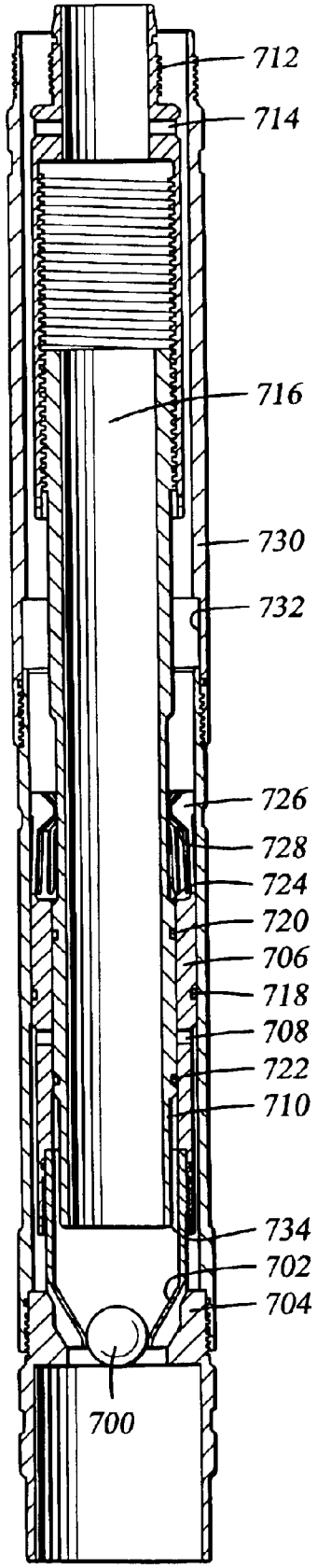
FIG. 7 is a longitudinal section view of an alternative embodiment of the invention as it would appear in a well bore after seating a ball in the ball seat to close the axial fluid delivery bore.

FIG. 7 represents another embodiment of the present invention. It shows a ball 700, a ball seat 702, a ball seat support member 704 annularly disposed around the ball seat in the position of FIG. 7, a sleeve 706 which is slidable and fixed to the ball seat with a lateral opening 708 therethrough and a stab 710 which is lockable to the sleeve and is mechanically fixed to the work string 712 which includes a lateral aperture 714 therethrough. The run in position for the tool would be the same as shown in FIG. 7 except that the ball 700 would not be present. FIG. 7 shows the device as it would appear in a wellbore after the ball 700 has been seated on the ball seat 702. The ball was dropped or pumped through the tubular from the surface after the tool was in position and at a predetermined time. The ball cannot pass beyond the ball seat since the inner diameter of the ball seat is smaller than the outer diameter of the ball. In this position, the ball sealably obstructs fluid flow in the axial fluid delivery bore 716. An o-ring 718 on the outside of the sleeve prevents fluid flow between the sleeve and outer member. Similarly, an o-ring 720 above the lateral port on the sleeve and an o-ring 722 below the lateral port 708 on the sleeve prevents fluid flow between the stab and the sleeve. Therefore, a fluid seal above the ball and ball seat allows this section of tubular to be pressurized in order to operate a hydraulic device such as a liner hanger. A lateral opening 714 located in the work string 712 provides a fluid path for pressurized fluid to travel to the hydraulic device (not shown). Once the hydraulic tool has completed its function, the increased pressure above the ball and ball seat can be relieved.

Figure 8:
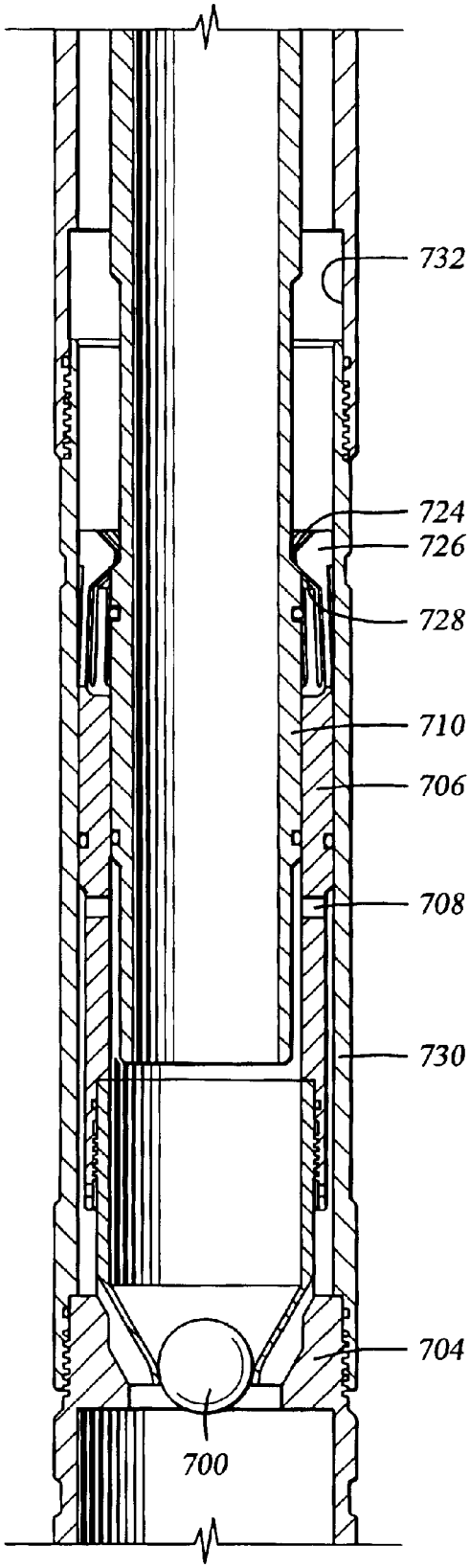
FIG. 8 is a view of the embodiment in FIG. 7 with a stab raised during the first stage of the ball seat opening.

FIG. 8 shows the device of FIG. 7 with the stab 710 having been moved up in relation to the sleeve 706 in order to expose the lateral opening 708 in the sleeve to fluid pressure. Therefore, a fluid path between areas above and below the ball and ball seat has been created, and the pressure above and below the ball and ball seat has been equalized. Axial movement of the work string 712 (shown in FIG. 7) can be performed from the surface of the well. Thus, upward axial movement of the work string provided the movement of the attached stab relative to the sleeve. A portion of the stab with a decreased outer diameter forms an outwardly facing shoulder 724. Similarly, a plurality of collet fingers 726 on an upper portion of the inner sleeve 706 have a section of increased inner diameter that forms an inward facing shoulder 728. Also shown in the FIG. 8, the stab 710 has been raised until the outwardly facing shoulder 724 on the stab contacts the inwardly facing shoulder 728 on the inner sleeve 706.

Figure 9:
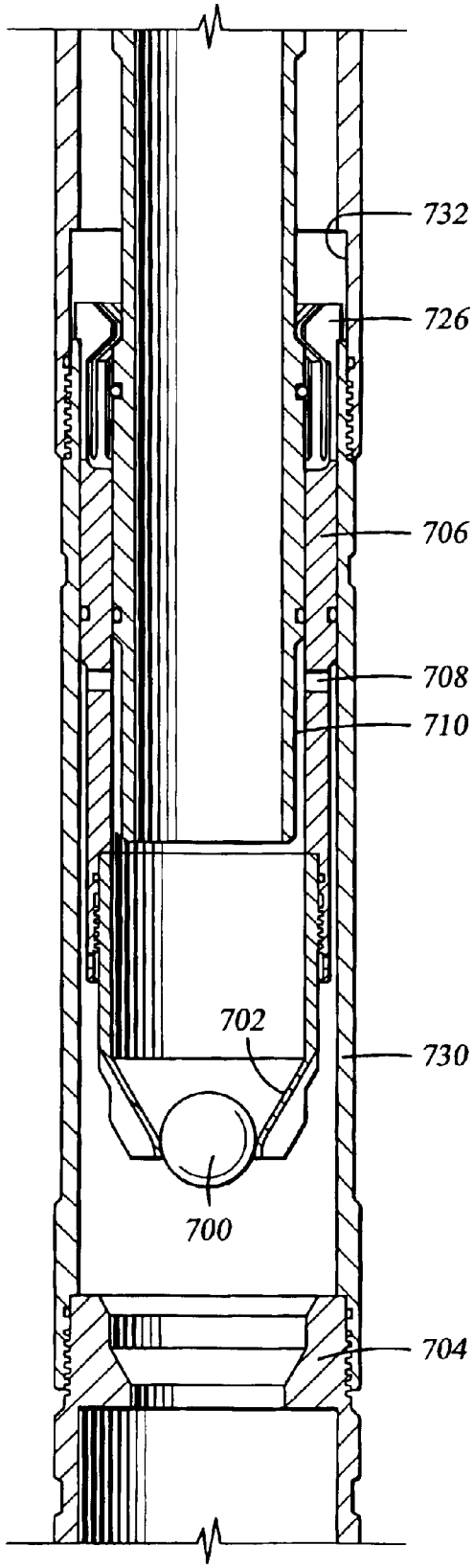
FIG. 9 is a view of the embodiment in FIG. 7 after the ball support member has been moved axially away from the ball seat support member in a second stage of the ball seat opening.
Figure 10:
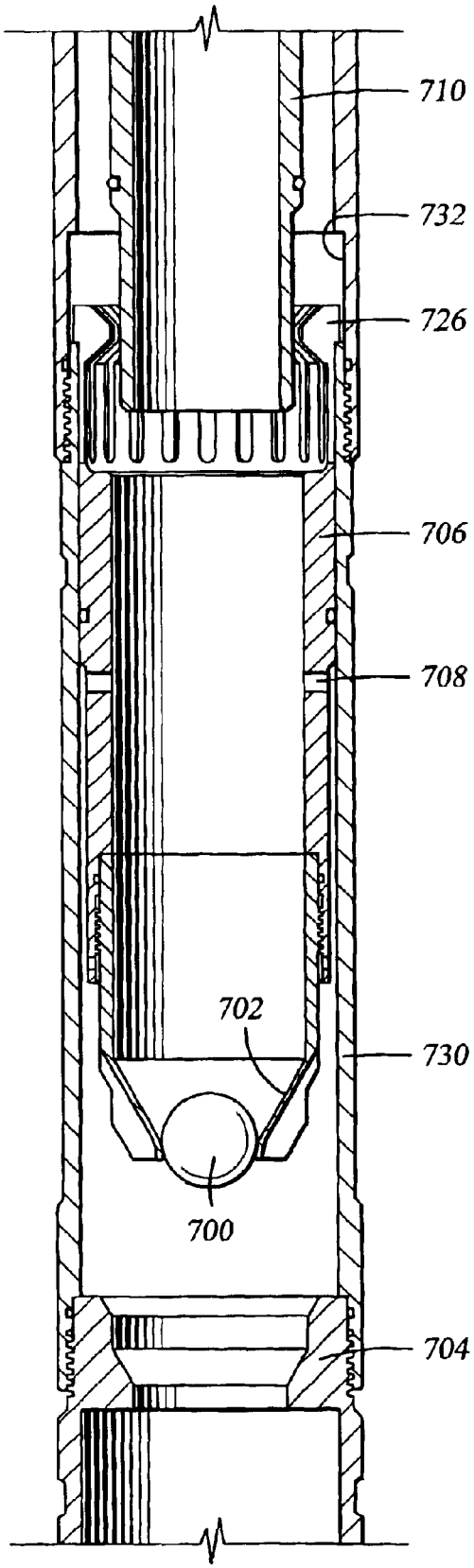
FIG. 10 is a view of the embodiment in FIG. 7 after the stab is raised in a subsequent stage of the ball seat opening.

FIG. 9 illustrates the next step in operation of the device in FIG. 7 whereby the stab 710, the sleeve 706, and the ball seat 702 have been raised in relation to the outer member 730 and the ball seat support member 704. Further upward movement of the work string placed the stab upward relative to the outer member. Upward movement of the sleeve in relation to the outer member is made possible by the contact between the outward shoulder on the stab contacting the inward shoulder on the sleeve. In FIG. 9, the sleeve has been raised until the outwardly biased collet fingers 726 on the sleeve contact a preformed profile 732 formed in the outer member 730. Similarly, one skilled in the art could envision using an outwardly biased c-ring instead of the collet fingers for engaging the outer member. FIG. 10 illustrates the device in a subsequent position showing the sleeve 706 fixed to the outer member 730 and stab 710 raised from its position in FIG. 9. At this point, checking the weight on the work string verifies that the liner is properly hung off since the work string should be free of the load created by the liner.

Figure 11:
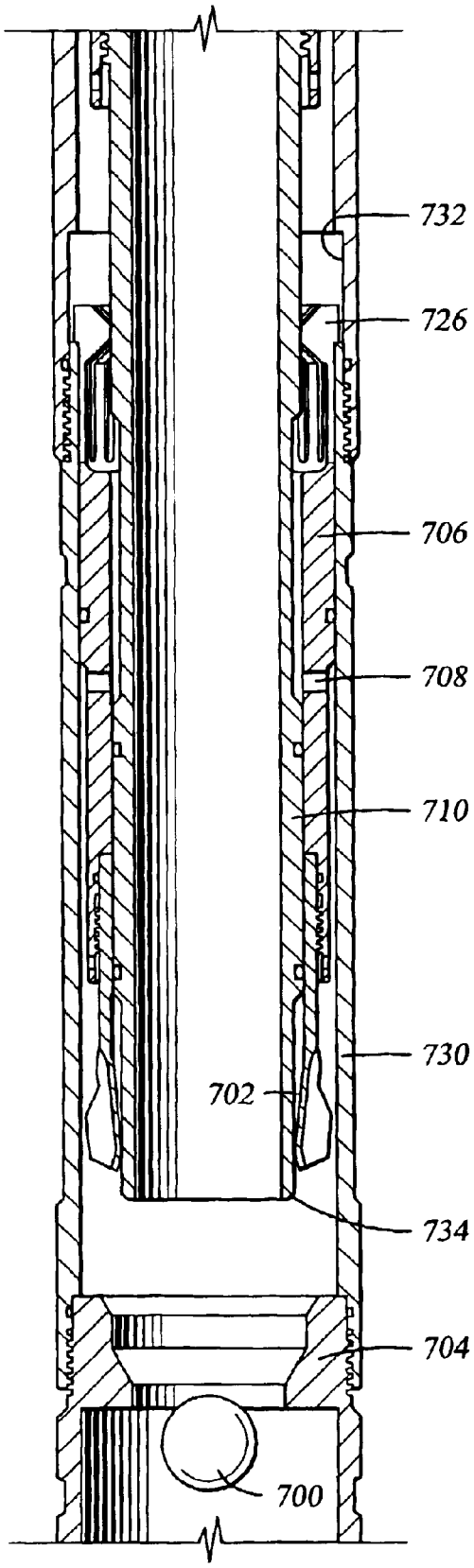
FIG. 11 is a view of the embodiment in FIG. 7 with an open axial fluid delivery bore after the stab opened the ball seat.

FIG. 11 shows the tool in FIG. 7 in its open position after the actual release of the ball downhole. Downward axial movement of the work string 712 (shown in FIG. 7) has moved the stab 710 axially downwards in relation to the sleeve 706 and the ball seat 702 which are secured to the outer member 730 by the expanded collet fingers 726 engaging the preformed profile 732 on the outer member. A lower portion of the stab comprises a ball seat engaging end 734 that has increased an inside diameter of the ball seat 702, permitting the ball 700 to fall free. The stab covers the inside of the expanded ball seat when the tool is in its open position. This creates a substantially open axial fluid delivery bore and protects subsequent equipment that passes through the tool. Further, one skilled in the art could envision a segmented lower portion of the stab with an initial inner diameter larger than the outer diameter of the ball. When this segmented lower portion of the stab engages the ball support it is collapsed down to an inner diameter smaller than the outer diameter of the ball in order to engage the ball and push it through the ball seat.

Figure 12:
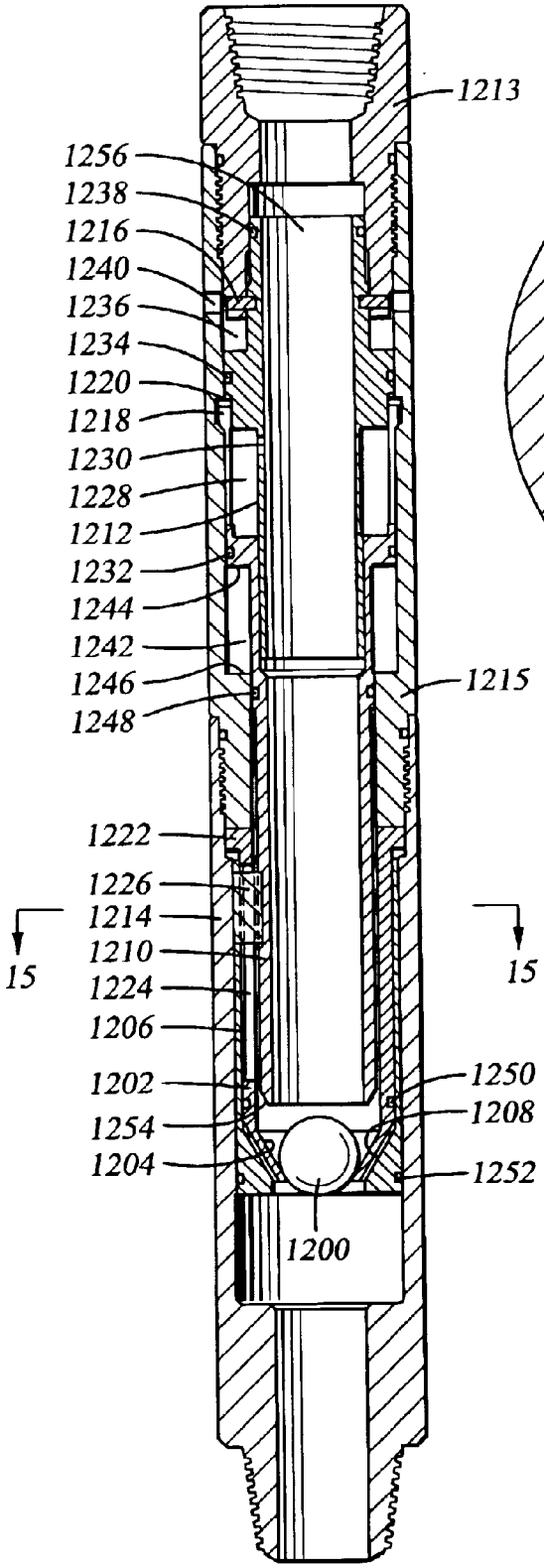
FIG. 12 is a longitudinal section view of another alternative embodiment of the invention as it would appear in a well bore after seating the ball in the ball seat to close the axial fluid delivery bore.
Figure 13:
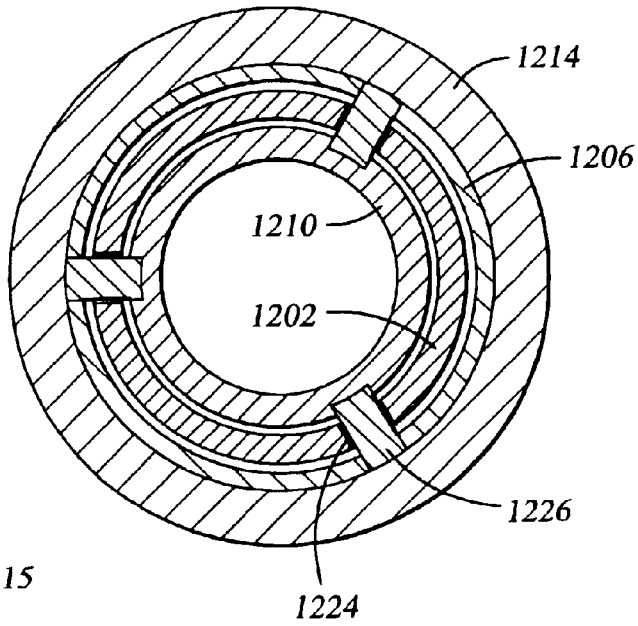
FIG. 13 is a section view across plane 15 of FIG. 12.

FIG. 12 illustrates another embodiment of the present invention. This figure shows a ball 1200, a ball support member 1202 with a ball seat 1204 positioned at a lower end, a ball seat support member 1206 with a ball seat support surface 1208 annularly disposed around the ball seat, a stab 1210, and a slidable sleeve 1212 secured to a top sub 1213 by a shear screw 1216. The top sub 1213 is connected to the upper outer member 1215 which is connected to the lower outer member 1214 to form the entire outer portion of the tool. A plurality of collet fingers 1218 on an upper portion of the stab 1210 are held within a preformed profile 1220 on the upper outer member 1215 due to the outer surface of the inner sleeve 1212 contacting the collet fingers and preventing them from moving out of the preformed profile. This secures the stab to the upper outer member. An upper portion 1222 of the ball support member 1202 possesses an increased outer diameter that engages an area of increased inner diameter of the lower outer member 1214. The ball seat support member 1206 extends upward from the ball seat support surface 1208 between the ball support member 1202 and the lower outer member 1214. Additionally, three longitudinally elongated apertures 1224 in the ball support member allow three keys 1226 to connect the ball seat support member 1206 to the stab 1210. FIG. 13 shows a cross section view of the tool across the area where the keys 1226 connect the ball seat support member 1206 to the stab 1210. The piston chamber 1228 is defined by a portion of the sleeve 1212 with a decreased outer diameter that passes inside a portion of the stab 1210 with an increased inner diameter. A lateral opening 1230 in the stab provides a fluid path for pressurized fluid to enter the piston chamber. Additionally, an o-ring 1232 circumscribing the stab and an o-ring 1234 circumscribing the sleeve seal the piston chamber. The o-ring 1234 around the sleeve separates fluid pressure between the piston chamber 1228 and the bore pressure chamber 1236. A second o-ring 1238 circumscribing the sleeve on the opposite end of the bore pressure chamber seals the bore pressure chamber from the rest of the tool. A portion of the upper outer member 1215 with a larger inner diameter than a portion of the sleeve 1212 with a decreased outer diameter and a lower portion of the top sub 1213 define the bore pressure chamber 1236. A lateral opening 1240 in the upper outer member adjoining the bore pressure chamber allows pressure equalization between the bore pressure chamber and the annular bore. The atmospheric, ATM, chamber 1242 is created between the stab 1210 and the upper outer member 1215 due to a cavity between an outwardly biased shoulder 1244 of the stab and the inward facing shoulder 1246 of the upper outer member. Since the ATM chamber is sealed prior to lowering the tool in the well, the gas within the ATM chamber remains at atmospheric pressure. An o-ring 1232 circumscribing the stab above the ATM chamber and an o-ring 1248 circumscribing the stab below the ATM chamber further seals the gas in the ATM chamber from the rest of the tool.

The run in position of this embodiment would be the tool as shown in FIG. 12 without the ball 1200. In the run in position, the ball seat 1204 has a smaller inner diameter than the outer diameter of the ball 1200. At a predetermined time once the tool is in position a ball was dropped or pumped through the bore in order to seal the axial fluid delivery bore 1256 by landing the ball on the ball seat. An o-ring 1250 circumscribing the ball support member adjacent to the ball seat provides a fluid seal between the ball support member 1202 and the ball seat support member 1206. Another o-ring 1252 circumscribing the ball seat support member 1206 prevents fluid passage between the ball seat support member and the lower outer member 1214. Therefore, fluid above the ball and ball seat can be pressurized to operate a hydraulic tool such as a liner hanger located above the ball and ball seat.

Figure 14:
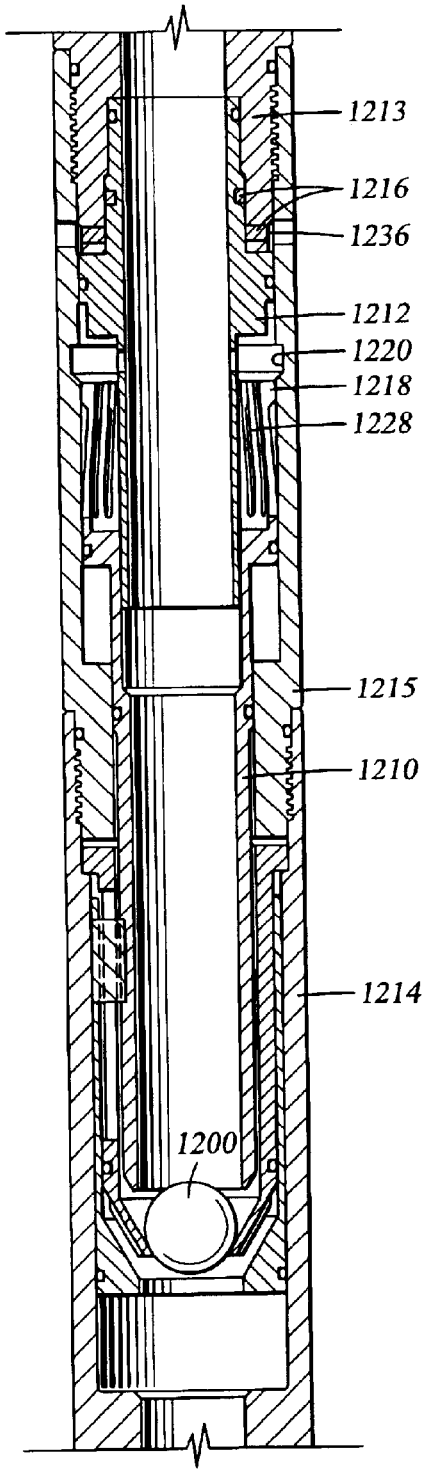
FIG. 14 is a view of the embodiment in FIG. 12 at a first stage in the opening of the ball seat.

FIG. 14 shows the sleeve 1212 raised with respect to the upper outer member 1215 in the first step in opening the axial fluid delivery bore. The movement of the sleeve was accomplished when fluid pressure above the ball and ball seat was increased beyond the pressure required to actuate the hydraulic tool. The increased fluid pressure within the axial fluid delivery bore acted in an upward force on the sleeve 1212 due to the increased pressure in the piston chamber 1228 relative to the bore pressure chamber 1236. This increased pressure sheared the shear screw 1216 that attached the sleeve to the top sub and pushed the sleeve upward with respect to the top sub. The portion of the sleeve 1212 with an increased outer diameter that previously contacted the collet fingers 1218 has been moved past the collet fingers and thereby allowed the collet fingers to move inward and out of the performed profile 1220.

Figure 15:
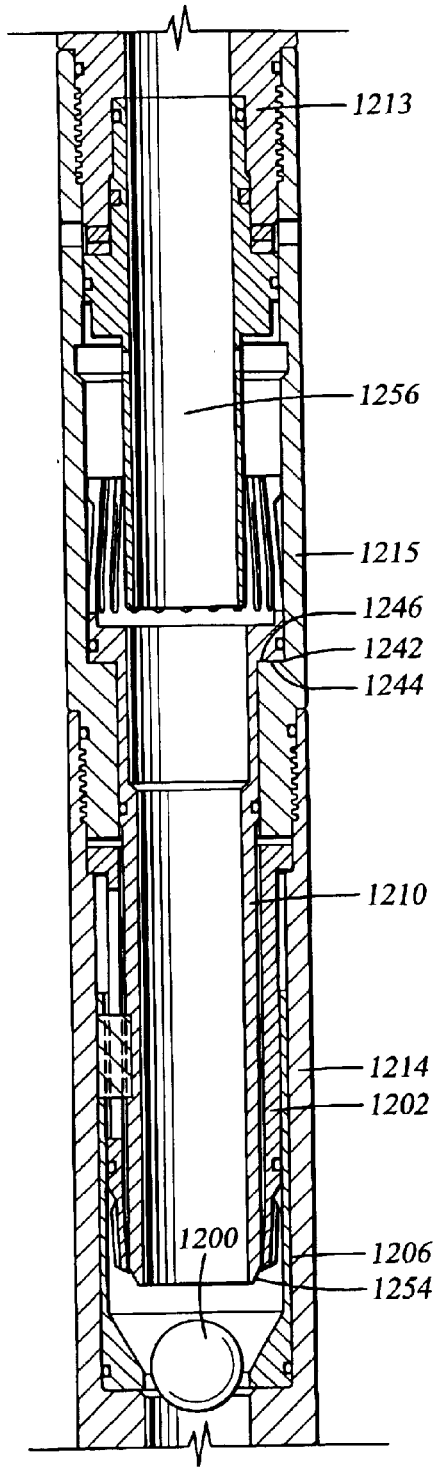
FIG. 15 is a view of the embodiment in FIG. 12 with an open axial fluid delivery bore after the stab opened the ball seat.

In FIG. 15, the stab 1210 and the ball seat support member 1206 have been moved axially downwards in relation to the ball support member 1202 and the lower outer member 1214. Under the increased pressure surrounding the ATM chamber 1242 while downhole, the ATM chamber volume collapsed once the collet fingers 1218 on the stab were liberated from the upper outer member and the stab was free to move. As a result, the stab moved downward until the shoulder 1244 of the stab that forms the top of the ATM chamber was proximate the shoulder 1246 of the upper outer member that forms the bottom of the ATM chamber. Since the ball seat support member 1206 is connected to the stab 1210 with three keys 1226, it traveled downward respectively with the stab. Therefore, the downward movement of the stab caused a lower portion of the stab comprising a ball seat engaging end 1254 to increase an inside diameter of the ball seat permitting the ball 1200 to fall free. In addition, one skilled in the art could envision a segmented stab with an initial inner diameter larger than the outer diameter of the ball, that when it engages the ball support it collapses down to an inner diameter smaller than the outer diameter of the ball in order to push the ball through the ball seat.

Figure 16:
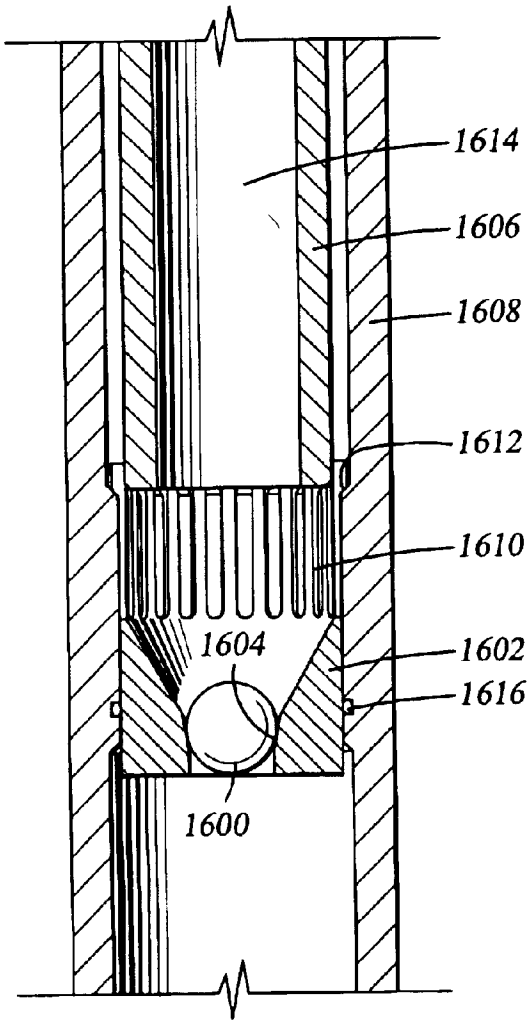
FIG. 16 is a longitudinal section view of another alternative embodiment of the invention as it would appear in a well bore after seating the ball in the ball seat to close the axial fluid delivery bore.

FIG. 16 illustrates another embodiment of the present invention. This figure shows a ball 1600, a ball support member 1602 with a ball seat 1604 at a lower portion thereof, a retaining member 1606, and an outer member 1608. Run in position for the tool would be the tool as shown in FIG. 16 without the ball 1600. A plurality of collet fingers 1610 on an upper portion of the ball support member 1602 engage a shoulder 1612 that is formed by a portion of the outer member 1608 with an increased inner diameter. The outer diameter of the retaining member 1606 contacts the inner diameter of the collet fingers and prevents their release from the shoulder 1612 on the outer member. Therefore, a securing assembly comprising the collet fingers 1610 and retaining member 1606 maintain the ball seat 1604 and ball support member 1602 in the run in position. At a predetermined time once the tool was in position a ball was dropped or pumped through the bore in order to seal the axial fluid delivery bore 1614 by landing the ball 1600 on the ball seat 1604. An o-ring 1616 circumscribing the inner diameter of the outer member prevents fluid flow between the ball support member and the outer member.

Figure 18:
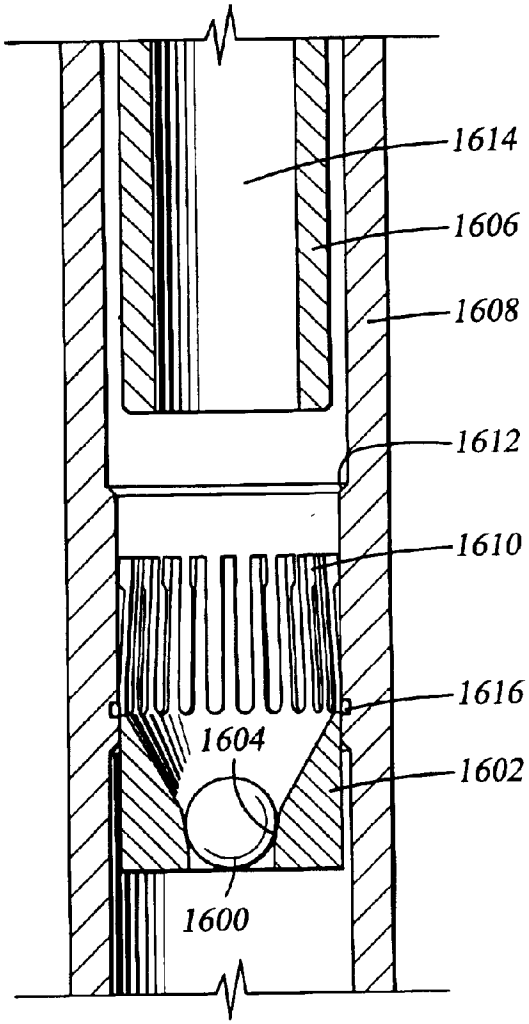
FIG. 18 is a view of the embodiment in FIG. 16 at a stage when the ball and ball seat member have moved axially downhole.
Figure 17:
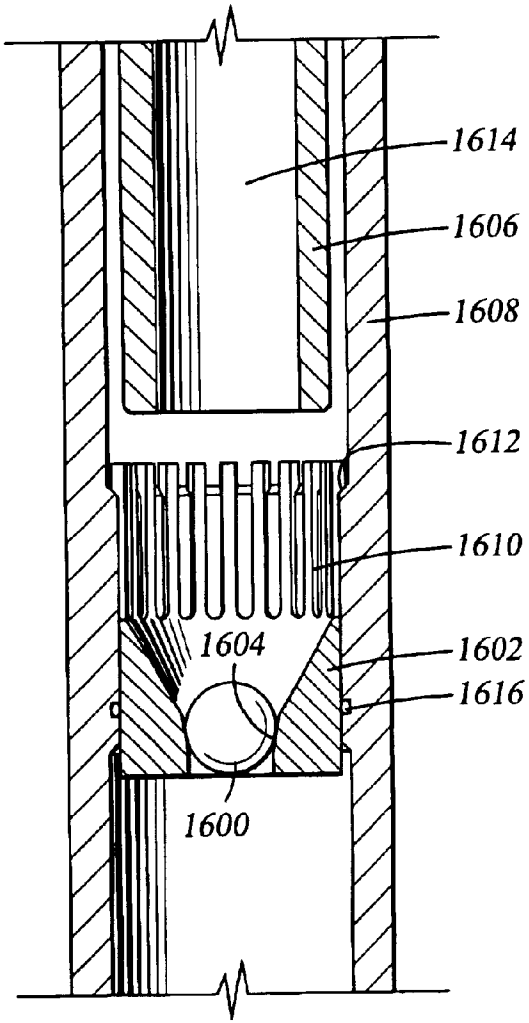
FIG. 17 is a view of the embodiment in FIG. 16 at a stage after raising the retaining member in order to release the ball and ball seat member.

FIG. 17 shows the retaining member 1606 axially raised with respect to the outer member 1608 and ball support member 1602. Movement of the retaining member that is attached to the work string (not shown) was accomplished by axial movement of the work string from the surface. Since the retaining member 1606 has been moved out of contact with the collet fingers 1610, the collet fingers can move inward and out of the shoulder 1612 on the outer member. Fluid pressure above the ball 1600 and ball support member 1602, gravity, or a biasing member acting on the ball support member has moved the ball and ball support member axially with respect to the outer member 1608 as shown in FIG. 18. This movement continues until the ball and ball seat drop down the borehole creating an open axial fluid delivery bore 1614.

Figure 19:
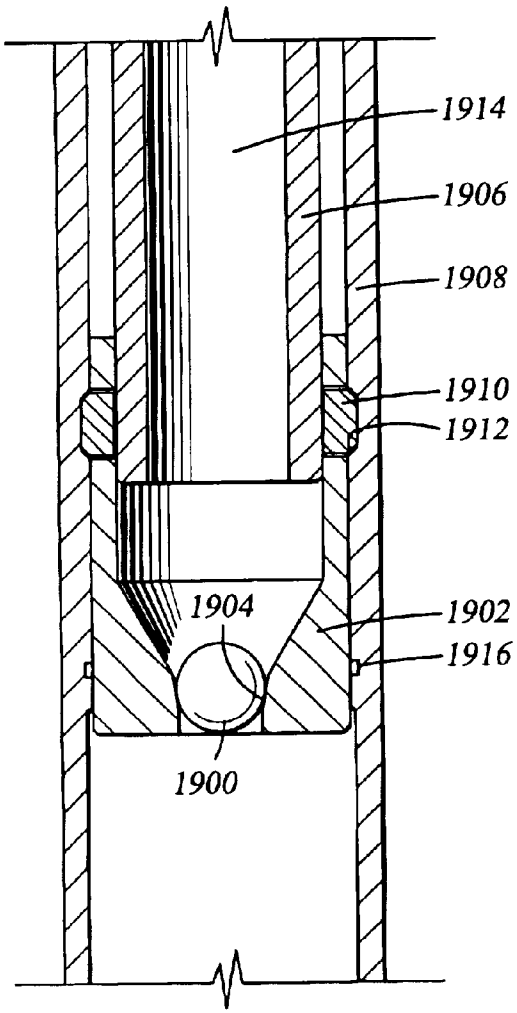
FIG. 19 is a longitudinal section view of another alternative embodiment of the invention as it would appear in a well bore after seating the ball in the ball seat to close the axial fluid delivery bore.

FIG. 19 shows another embodiment of the present invention. This figure shows a ball 1900, a ball support member 1902 with a ball seat 1904 at a lower portion thereof, a retaining member 1906, and an outer member 1908. Run in position for the tool would be the tool as shown in FIG. 19 without the ball 1900. A plurality of dogs 1910 on an upper portion of the ball support member 1902 engage a preformed profile 1912 that is formed by a portion of the outer member 1908 with an increased inner diameter. The outer diameter of the retaining member 1906 contacts the inner surface of the dogs 1910 and prevents their release from the preformed profile 1912 on the outer member. Therefore, a securing assembly comprising the dogs 1910 and retaining member 1906 maintain the ball seat 1904 and ball support member 1902 in the run in position. At a predetermined time once the tool was in position a ball was dropped or pumped through the bore in order to seal the axial fluid delivery bore 1914 by landing the ball 1900 on the ball seat 1904. An o-ring 1916 circumscribing the inner diameter of the outer member prevents fluid flow between the ball support member and the outer member.

Figure 21:
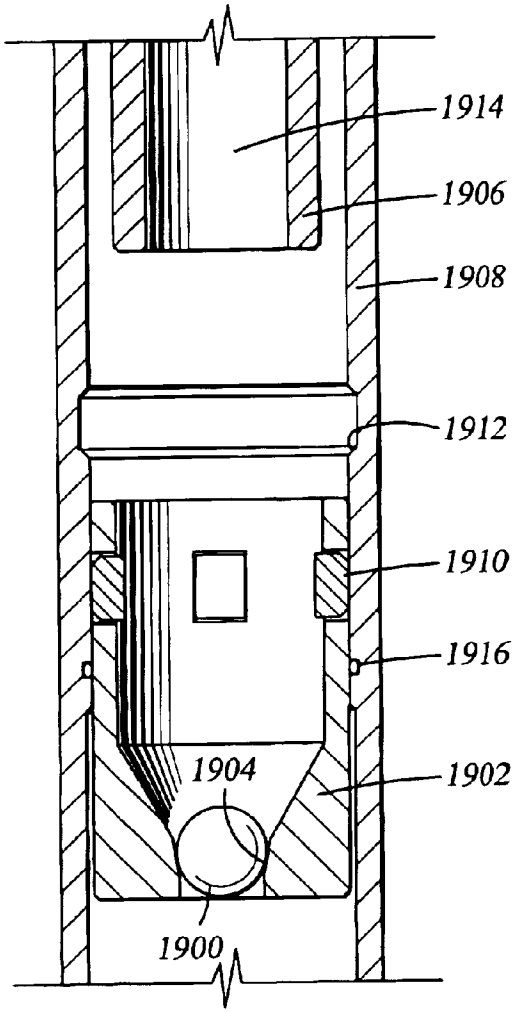
FIG. 21 is a view of the embodiment in FIG. 16 at a stage when the ball and ball seat member have moved axially downhole.
Figure 20:
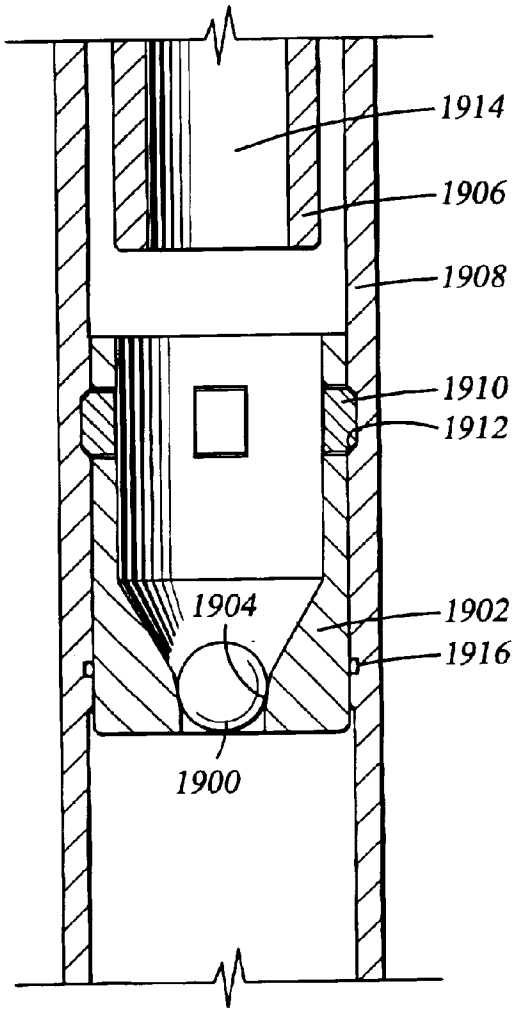
FIG. 20 is a view of the embodiment in FIG. 19 at a stage after raising the retaining member in order to release the ball and ball seat member.

FIG. 20 shows the retaining member 1906 axially raised with respect to the outer member 1908 and ball support member 1902. Movement of the retaining member that is attached to the work string (not shown) was accomplished by axial movement of the work string from the surface. Since the retaining member 1906 has been moved out of contact with the dogs 1910, the dogs can move inward and out of the preformed profile 1912 on the outer member. Fluid pressure above the ball 1900 and ball support member 1902, gravity, or a biasing member acting on the ball support member has moved the ball and ball support member axially with respect to the outer member 1908 as shown in FIG. 21. This movement continues until the ball and ball seat drop down the borehole producing an open axial fluid delivery bore 1914.

Figure 22:
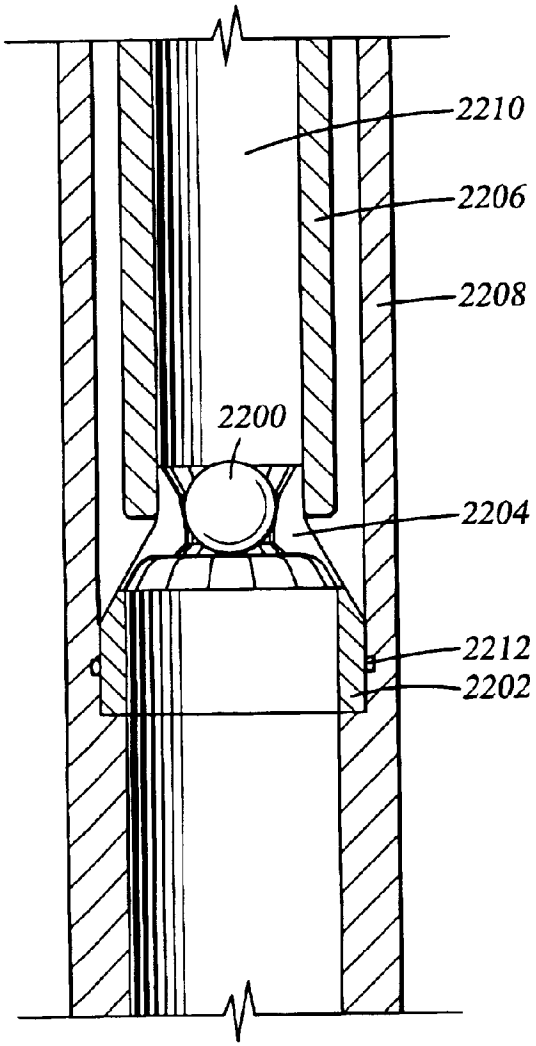
FIG. 22 is a longitudinal section view of another alternative embodiment of the invention as it would appear in a well bore after seating the ball in the ball seat to close the axial fluid delivery bore.

FIG. 22 shows another embodiment of the present invention. This figure shows a ball 2200, a ball support member 2202 with a segmented ball seat 2204 at an upper portion thereof, a support member 2206, and an outer member 2208. Run in position for the tool would be the tool as shown in FIG. 22 without the ball 2200. An inner diameter of the support member 2206 contacts an outer diameter of the ball seat 2204 and prevents radial outward expansion of the ball seat that would thereby increase the inner diameter of the ball seat. At a predetermined time once the tool was in position a ball was dropped or pumped through the bore in order to seal the axial fluid delivery bore 2210 by landing the ball 2200 on the ball seat 2204. An o-ring 2212 circumscribing the inner diameter of the outer member prevents fluid flow between the ball support member and the outer member.

Figure 24:
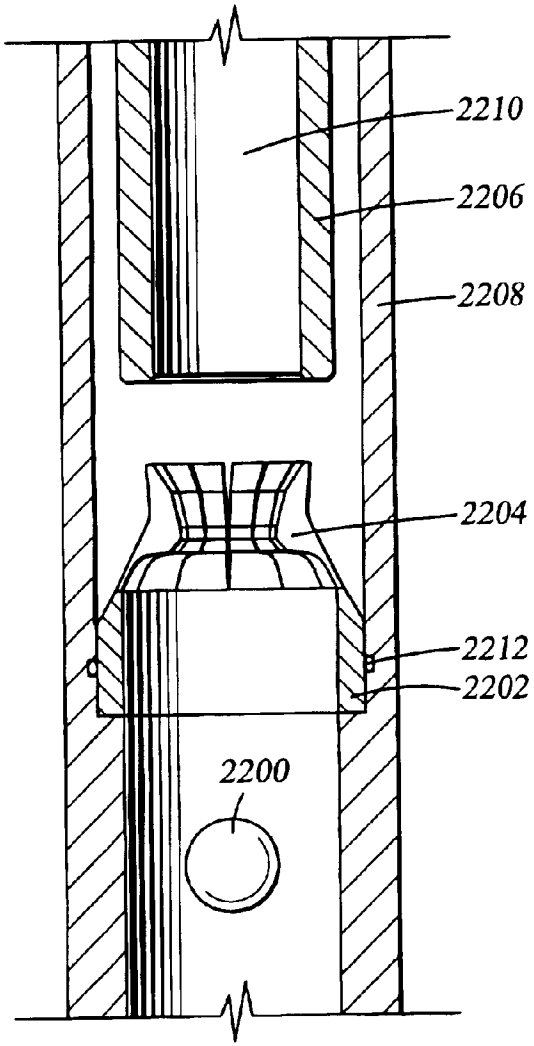
FIG. 24 is a view of the embodiment in FIG. 22 with an open axial fluid delivery bore.
Figure 23:
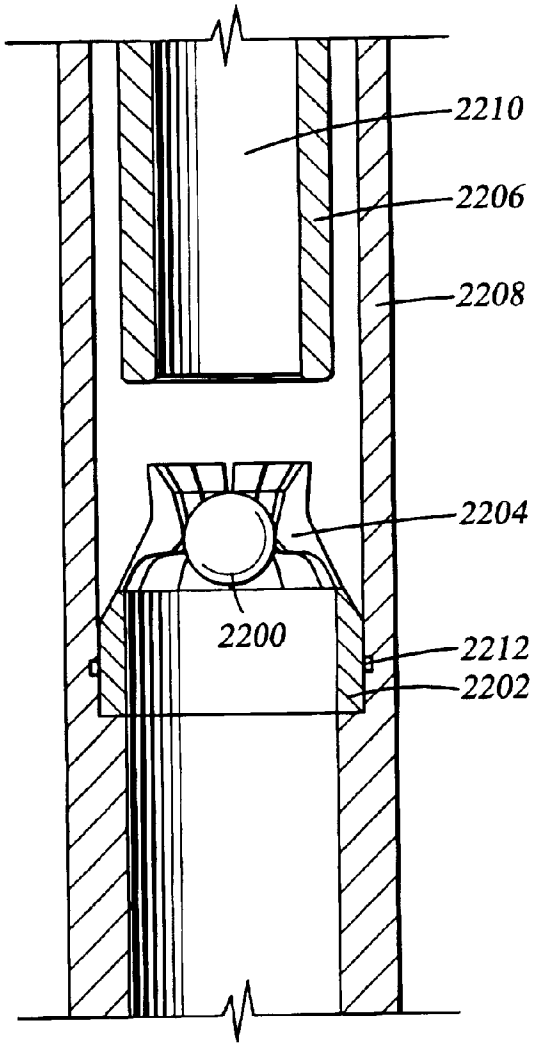
FIG. 23 is a view of the embodiment in FIG. 22 with the inner sleeve raised during the first stage of the ball seat opening.

FIG. 23 shows the support member 2206 axially raised with respect to the outer member 2208 and ball support member 2202. Movement of the support member that is attached to the work string (not shown) was accomplished by axial movement of the work string from the surface. Since the inner diameter of the support member 2206 has been moved out of contact with the outer diameter of the ball seat 2204, the ball seat segments are free to open up in the radial direction. Radial expansion of the ball seat increases the inner diameter of the ball seat 2204 until the ball 2200 is permitted to fall down hole as seen in FIG. 24.

Figure 27:
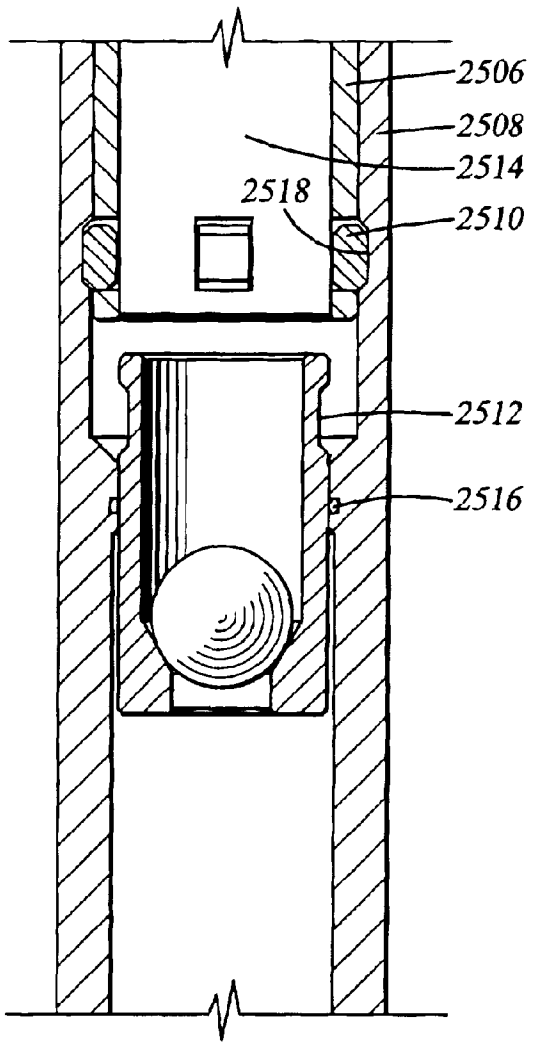
FIG. 27 is a view of the embodiment in FIG. 26 at a stage when the ball and ball seat member have moved axially downhole.
Figure 26:
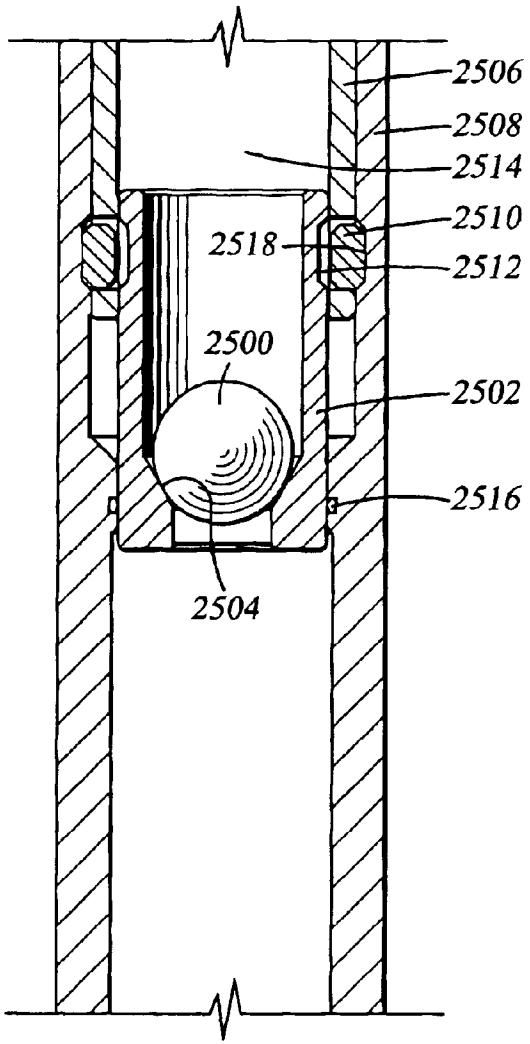
FIG. 26 is a view of the embodiment in FIG. 25 at a stage after raising the retaining member in order to release the ball and ball seat member.
Figure 25:
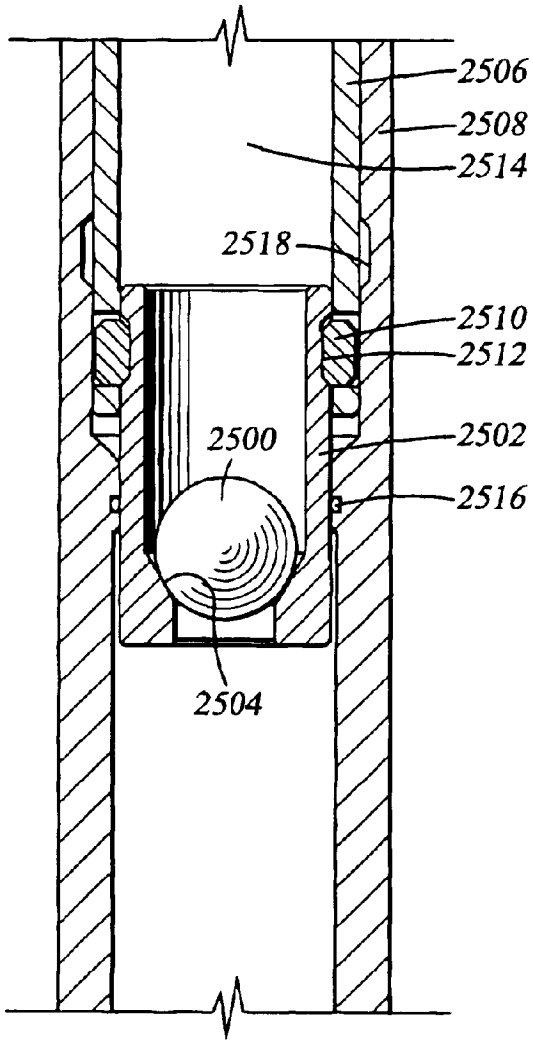
FIG. 25 is a longitudinal section view of another alternative embodiment of the invention as it would appear in a well bore after seating the ball in the ball seat to close the axial fluid delivery bore.

FIG. 25 illustrates another embodiment of the present invention. This figure shows a ball 2500, a ball support member 2502 with a ball seat 2504 at a lower portion thereof, a retaining member 2506, and an outer member 2508. Run in position for the tool would be the tool as shown in FIG. 25 without the ball 2500. A plurality of dogs 2510 positioned at a lower end of the retaining member 2506 engage a preformed profile 2512 on the outside diameter of the ball support member 2502 and prevent axial movement of the ball seat and ball support member relative to the retaining member. The inside diameter of the outer member 2508 contacts the outside surface of the dogs 2510 and prevents their release from the preformed profile 2512 on the ball support member. Therefore, a securing assembly comprising the dogs 2510 and retaining member 2506 maintain the ball seat 2504 and ball support member 2502 in the run in position. An o-ring 2516 circumscribing the outer diameter of the ball support member prevents fluid flow between the ball support member and the outer member. FIG. 26 shows the retaining member 2506 axially moved to a position adjacent a section 2518 of the outer member 2508 with an increased inside diameter, thereby permitting the dogs 2510 to move outward and out of the preformed profile 2512 on the ball support member 2502. Therefore, fluid pressure above the ball and ball support member, gravity, or a biasing member acting on the ball support member can move the ball and ball support member axially as shown in FIG. 27. This axial movement continues until the ball and ball seat drop down the borehole creating an open axial fluid delivery bore 2514.

Figure 30:
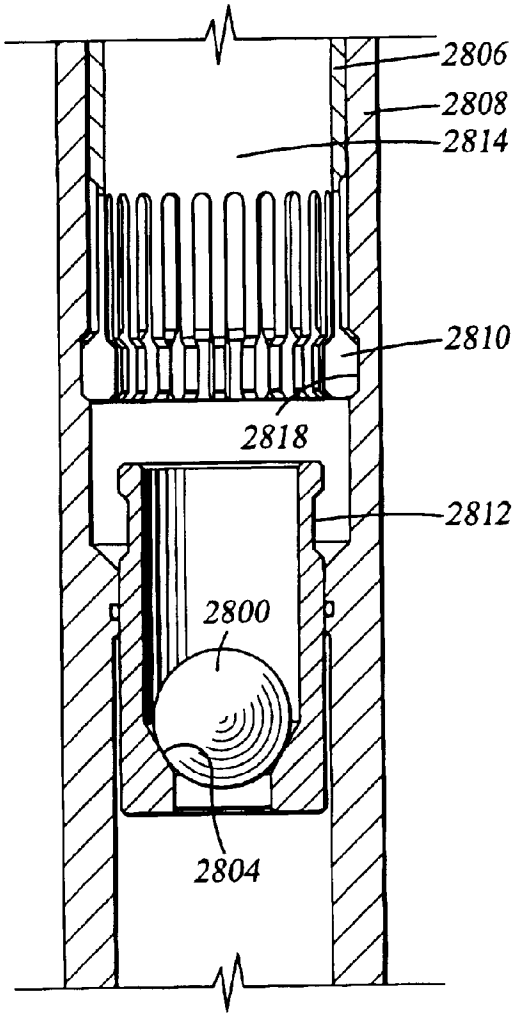
FIG. 30 is a view of the embodiment in FIG. 29 at a stage when the ball and ball seat member have moved axially downhole.
Figure 29:
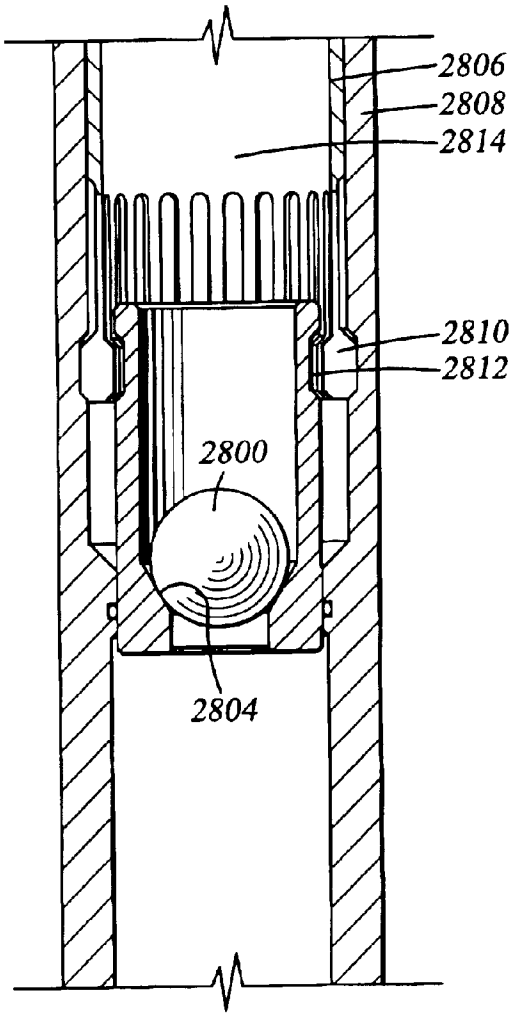
FIG. 29 is a view of the embodiment in FIG. 28 at a stage after raising the retaining member in order to release the ball and ball seat member.
Figure 28:
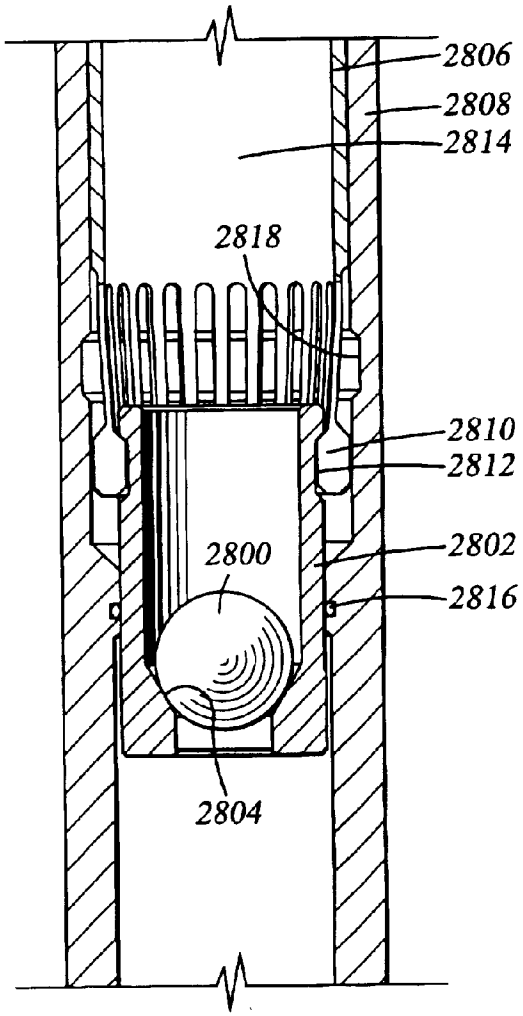
FIG. 28 is a longitudinal section view of another alternative embodiment of the invention as it would appear in a well bore after seating the ball in the ball seat to close the axial fluid delivery bore.

FIG. 28 illustrates another embodiment of the present invention. This figure shows a ball 2800, a ball support member 2802 with a ball seat 2804 at a lower portion thereof, a retaining member 2806, and an outer member 2808. Run in position for the tool would be the tool as shown in FIG. 28 without the ball 2800. A plurality of collet fingers 2810 positioned at a lower end of the retaining member 2806 engage a preformed profile 2812 on the outside diameter of the ball support member 2802 and prevent axial movement of the ball seat and ball support member relative to the retaining member. The inside diameter of the outer member 2808 contacts the outside diameter of the collet fingers 2810 and prevents their release from the preformed profile 2812 on the ball support member. Therefore, a securing assembly comprising the collet fingers 2810 and retaining member 2806 maintain the ball seat 2804 and ball support member 2802 in the run in position. An o-ring 2816 circumscribing the outer diameter of the ball support member prevents fluid flow between the ball support member and the outer member. FIG. 29 shows the retaining member 2806 axially moved to a position adjacent a section 2818 of the outer member 2808 with an increased inside diameter. This permits the collet fingers 2810 to expand outward and out of the preformed profile 2812 on the ball support member 2802. Therefore, fluid pressure above the ball and ball support member, gravity, or a biasing member acting on the ball support member can move the ball and ball support member axially as shown in FIG. 30. This axial movement continues until the ball and ball seat drop down the borehole creating an open axial fluid delivery bore 2814.

While the foregoing is directed to embodiments of the present invention, other and further embodiments of the invention may be devised without departing from the basic scope thereof, and the scope thereof is determined by the claims that follow.

What is claimed is:

1. A method for setting a tool in a wellbore, comprising:

running a setting tool into the wellbore, the setting tool carrying the tool to be set in the wellbore and defining an axial fluid delivery bore for fluidly communicating the wellbore with the surface;

closing the fluid delivery bore to at least restrict fluid flow therethrough;

setting the tool with hydraulic pressure;

mechanically manipulating at least a portion of the setting tool to open the fluid delivery bore.

2. The method of claim 1, wherein mechanically manipulating comprises axially moving a stabbing member to engage and open a ball seat.

3. The method of claim 1, wherein mechanically manipulating originates from the surface.

4. The method of claim 1, wherein closing the fluid delivery bore comprises disposing a ball on a ball seat of a valve to restrict a fluid pathway of the valve and wherein mechanically manipulating at least the portion of the setting tool to open the fluid delivery bore comprises rotating the valve to remove the ball as a flow obstruction and positioning another fluid pathway of the valve in fluid communication with the fluid delivery bore.

5. A downhole tool, comprising:

a cylinder body defining a cylinder body bore;

a ball seat support member axially separatable from a ball seat disposed within the cylinder body bore;

a stabbing member axially slidably disposed within the cylinder body bore, wherein the stabbing member defines a fluid delivery bore and comprises a ball seat engaging end adapted to open the ball seat when the ball seat is separated axially from the ball seat support member.

6. The apparatus of claim 5, further comprising a ball seat support member defining a ball seat support surface for engaging and supporting the ball seat, wherein the ball seat support member and the ball support member are relatively axially movable with respect to one another.

7. The apparatus of claim 5, wherein the ball seat defines an inner diameter smaller than an outer diameter of a ball positionable on the ball seat in a first configuration.

8. The apparatus of claim 5, wherein the ball seat defines an inner diameter smaller than an outer diameter of a ball positionable on the ball seat in a first configuration and an inner diameter larger than the outer diameter of the ball in a second configuration.

9. The apparatus of claim 5, wherein the ball support member is rigidly disposed on the cylindrical body and the ball seat support member is axially slidable with respect to the cylindrical body and wherein the stabbing member and the ball seat support member are rigidly coupled to one another.

10. The apparatus of claim 5, further comprising a ball seat support member defining a ball seat support surface for engaging and supporting the ball seat, wherein the ball seat support member is rigidly disposed on the cylindrical body.

11. The apparatus of claim 10, wherein the ball support member is axially movable away from the ball seat support member.

12. The apparatus of claim 5, wherein the stabbing member and the ball support member are axially moveable with respect to one another.

13. The apparatus of claim 5, wherein the ball seat engaging end has a larger inner diameter than an outer diameter of the ball.

14. The apparatus of claim 5, wherein the ball support member contains a lateral aperture adapted to equalize the pressure above and below the ball seat and a ball positioned on the ball seat at a predetermined time.

15. A method of operating a downhole tool defining an axial fluid delivery bore for delivery of fluid from a surface into a wellbore, comprising:

providing a ball support member comprising a ball seat that is supported by a ball seat support member;

running the downhole tool into the wellbore;

seating a ball in the ball seat wherein the ball has a larger outer diameter than an inner diameter of the ball seat in order to at least restrict fluid flow between the wellbore and the axial fluid delivery bore;

separating the ball support member axially away from the ball seat support member; and mechanically expanding the ball seat such that the ball seat has a larger inner diameter than an outer diameter of the ball.

16. The method of claim 15, further comprising moving a stab relative to the ball support member and expanding the inner diameter of the ball seat.

17. The method of claim 16, wherein moving the stab relative to the ball support member covers the expanded ball seat.

18. The method of claim 16, wherein the lower portion of the stab defines a ball seat engaging end that has a larger inner diameter than an outer diameter of the ball.

19. The method of claim 16, wherein the moving of the stab relative to the ball support member is driven hydraulically.

20. The method of claim 16, wherein the moving of the stab relative to the ball support member is driven mechanically.

21. The method of claim 16, wherein the moving of the stab relative to the ball support member is performed mechanically by mechanical manipulation originating from the surface.

22. The method of claim 15, wherein seating the ball in the ball seat comprises dropping a ball into the axial fluid delivery bore.

23. The method of claim 15, wherein running the downhole tool into the wellbore comprises carrying a liner hanger with the downhole tool on a workstring.

24. The method of claim 23, further comprising setting the liner hanger while the ball is seated on the ball seat.

25. The method of claim 15, wherein separating the ball support member axially away from the ball seat support member comprises exposing a lateral opening on the ball support member whereby a fluid pathway above and below the ball seat is allowed.

26. An downhole tool, comprising:

a cylinder body having an axial fluid delivery bore formed therein;

a ball seat support member and a ball seat disposed within the axial fluid deliver bore; and a sleeve axially movable in the body, wherein the sleeve retains the ball seat support member in a locked position relative to the sleeve in a first position and an unlocked position relative to the sleeve in a second position, and whereby in the second position, the ball support member can be moved downwards relative to the ball seat.

* * * * *

UNITED STATES PATENT AND TRADEMARK OFFICE

CERTIFICATE OF CORRECTION

PATENT NO. : 6,866,100 B2
APPLICATION NO. : 10/227148
DATED : March 15, 2005
INVENTOR(S) : Tarald Gudmestad, David E. Hirth and Gerald D. Pedersen It is certified that error appears in the above-identified patent and that said Letters Patent is hereby corrected as shown below:

Column 13, Claim 1, Line 34: After “pressure;”, insert --and--

Column 16, Claim 26, Line 5: Change “sleeve” to --body--

Column 16, Claim 26, Line 6: Change “sleeve” to --body--

Signed and Sealed this

Twelfth Day of December, 2006

JON W. DUDAS
*Director of the United States Patent and Trademark Office*